US007874897B2

(12) United States Patent
Marshall, Jr.

(10) Patent No.: US 7,874,897 B2
(45) Date of Patent: Jan. 25, 2011

(54) GEMSTONE FLAT POLISHER MECHANIZED

(75) Inventor: Oscar Brooks Marshall, Jr., 828 Wagstaff Rd., Paradise, CA (US) 95969

(73) Assignee: Oscar Brooks Marshall, Jr., Paradise, CA (US)

( * ) Notice: Subject to any disclaimer, the term of this patent is extended or adjusted under 35 U.S.C. 154(b) by 0 days.

(21) Appl. No.: 12/384,585

(22) Filed: Apr. 6, 2009

(65) Prior Publication Data

US 2010/0255760 A1 Oct. 7, 2010

(51) Int. Cl.
*B24B 31/00* (2006.01)

(52) U.S. Cl. ..... 451/113; 451/326

(58) Field of Classification Search ..... 451/104, 451/113, 285–289, 326
See application file for complete search history.

(56) References Cited

U.S. PATENT DOCUMENTS 1,918,018 A * 7/1933 Clark ..... 366/112
3,267,618 A * 8/1966 Giezentanner ..... 451/286
3,769,758 A * 11/1973 McDonald ..... 451/326
3,793,780 A * 2/1974 Musschoot ..... 451/80
4,043,081 A * 8/1977 DeTray ..... 451/286
4,047,343 A * 9/1977 Smith ..... 451/32

* cited by examiner

*Primary Examiner*—Maurina Rachuba

(57) ABSTRACT

A vibrating lap polishing system for flat items, comprising a polish pan with flexible bottom mounted on a base having three or more round-head bolts of equal height extending vertically above the base surface and positioned at one hundred twenty degree spacing on a circle about the base center; a center bolt attached to and extending below the pan center into a nut rotated by horizontally positioned gears, a center gear which rotates the nut and an outer meshed gear available from the outside work area to raise and lower the workpiece during operation. Means, which put no holes in the polish pan, are provided to pull the polish pan down onto the round-head bolts which create raised areas in the flexible pan-bottom. A flat-bottomed multi-item workpiece is circulated and rotated in an unsynchronized manner over the raised areas which creates a complete polish of the workpiece after sufficient cycles.

6 Claims, 29 Drawing Sheets

GEMSTONE FLAT POLISHER MECHANIZED

CROSS-REFERENCE TO RELATED APPLICATIONS

None.

FEDERALLY SPONSORED RESEARCH

Not applicable.

SEQUENCE LISTING OR PROGRAM

Not applicable.

COPYRIGHT NOTIFICATION

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND

1. Field of the Invention

This invention relates to the polishing of gemstones by lapidary means, and more particularly, to a vibratory polishing system that polishes flat surfaces by vibratory means.

2. Description of Prior Art

No patented prior art has been found relating to this process. However, there have been a number of descriptions of basic flat polishing using the vibrating pan ("vibralaps") in the lapidary literature. These processes all use flat-bottomed pans that have no local elevated areas. The flat-bottomed pans have flat or slightly concave bottoms. Even if the pan-bottom starts out flat, continued grinding may cause the bottom to become concave. These pans suffer from the deficiency that, due to the shapes and sizes of the some of the specimens being polished, pressure is never put on some of the areas being polished. It is well known that pressure on all areas of the specimens is required to completely polish a surface. FIGS. 13 and 13A demonstrate this. For small specimens in FIG. 13, it can be seen that the specimen bottoms make full, or almost full, contact with the pan-bottom. FIG. 13A shows that, for a larger specimen, the pan only contacts the outer edges of the specimen. Thus, only the outer edges of the larger specimen are polished. It is desirable that the diameter of the larger specimen being polished be as large as possible so that many more small specimens, which are cast into the larger specimen, can be polished simultaneously. Even if the pan bottom is perfectly flat as in FIG. 13B, the large specimen contacts a large distributed area so that no incremental area of the specimen presses very hard against the pan-bottom. This results in the surface being polished very slowly or not completely. The equipment and processes described herein correct this deficiency.

SUMMARY OF THE INVENTION

The vibratory polisher system circulates the casting around a specially designed polish pan mounted on a specially designed base assembly. The polish pan is constructed using a flexible pan for its bottom that can be deformed by moderate pressure. The base that the polish pan sits on has raised areas (bumps) which cause the polish pan, which sits on the base, to have a locally convex bottom at three or more locations around the polish pan bottom. This occurs when the pan is pulled down against the bumps by a pan-bracket assembly. A special casting consisting of flat-bottomed objects all cemented together is created. The flat bottoms are aligned in a horizontal plane. Earlier grinding operations prepare the casting to be polished. The convex areas of the polish pan bottom put pressure on small areas of the casting, and as the casting circulates and rotates, the entire outer area of the casting surface is eventually polished. This is due to the fact that the circulator and rotator motors are not synchronized in their rotations, resulting in random progression of the casting around the pan. There is an adjustable center bump that can be raised to polish the inner areas of the casting.

DRAWINGS

Figures

In the drawings, closely related figures have the same number but different suffixes.

FIG. 6D-1 shows the circulator motor simplified bottom view with its square-shaft hole.

FIG. 6D-2 shows the casting rotation motor simplified bottom view with its square hole.

DRAWINGS

Reference Numerals

Figure 1:
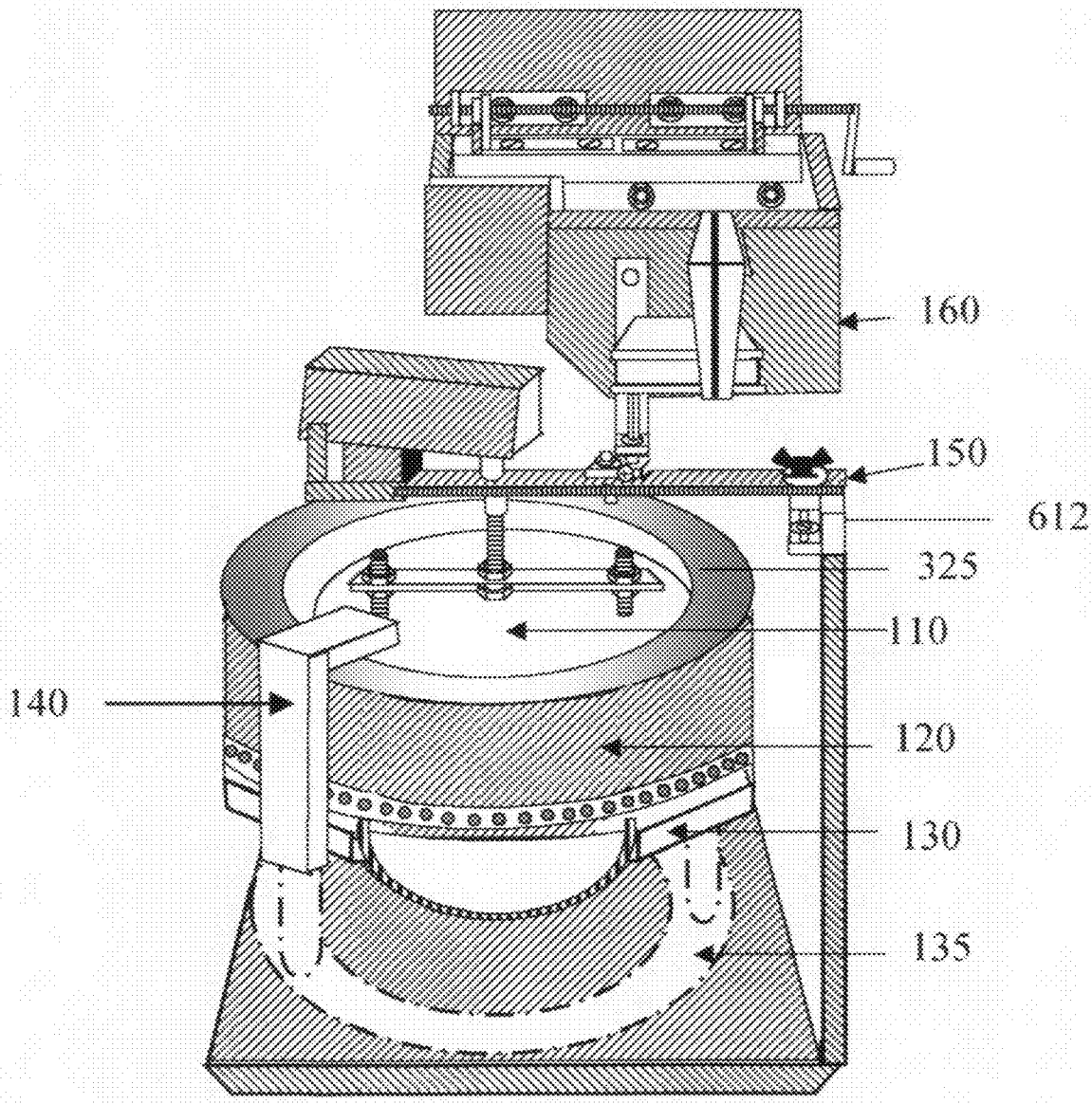
FIG. 1 is a simplified perspective drawing of the gemstone flat polisher mechanized.

| ITEM # | ITEM NAME | FIGURE # |
|---|---|---|
| 110 | casting | 1, 1A, 1B, 2, 10, 11, 12A |
| 120 | polish pan | 1, 1A, 3, 3A, 4C, 7B, 8C, 9, 10, 11 |
| 130 | base assembly | 1, 1A, 4, 4B, 4C, 7B, 9, 11 |
| 135 | vibrating table assembly. | 1A, 1 |
| 140 | pan bracket assembly | 1, 4B, 4C, 5, 5A |
| 150 | circulator system | 1, 1A, 1B, 6, 11 |
| 160 | horizontal slide assembly | 1, 1A, 7, 7B |
| 170 | support structure | 1A, 6K, 7A, 7B, |
| 212 | flat-bottomed rocks | 2 |
| 214 | disc | 2 |
| 216 | casting rotation fixture | 1B, 2 |
| 217 | height adjustment nuts | 2 |
| 218 | casting center axis | 2 |
| 220 | casting plane surface | 2 |
| 222 | lifting stud | 2, 8G, 8H, 8F |
| 224 | leveling nuts | 1B, 2 |
| 226 | casting axis pattern | 2A, 10 |
| 228 | casting rotation screw | 1B, 2, 2A, 10 |
| 230 | top section | 2 |
| 316 | polish pad | 3, 9 |
| 318 | polish pad underlayer | 3, 9 |
| 320 | polish-pan-bottom | 3, 9 |
| 322 | pan-sides | 3, 3A |
| 323 | nut-washer | 3, 4B, 9 |
| 324 | o-ring | 3, 4B, 9 |
| 325 | splash rim | 1, 3A, 3 |
| 326 | retainer band | 1A, 3, 3A |
| 327 | retainer band lock | 3A |
| 328 | retainer ring | 3A, 3 |
| 330 | center-bump bolt | 3, 3A, 4B, 9 |
| 332 | center bump bolt head | 3, 4B, 4C |
| 410 | base-board | 4, 4B |
| 412 | outer bump bolts | 4, 4B, 4C, 9, 11 |
| 416 | limit bolt | 4, 4B, 4C, 9 |
| 418 | driving gear | 4, 11 |
| 420 | driven gear | 4, 4A, 4B |

-continued

| ITEM # | ITEM NAME | FIGURE # |
|---|---|---|
| 422 | gear hold-down bar | 4, 4B |
| 423 | hole | 4 |
| 424 | pan bracket attachment points | 4, 4B |
| 425 | pulldown-bolt circle | 4 |
| 426 | square nut | 4, 4A, 4B, 9 |
| 427 | counterbore washer | 4B |
| 428 | gear teeth | 4, 4A |
| 429 | washer | 4B |
| 430 | square hole | 4A |
| 516 | pulldown bolt | 4B, 5, 5A |
| 518 | guide bolt | 4B, 5, 5A |
| 520 | stop nut | 5, 5A |
| 522 | threaded hole | 5, 5A |
| 524 | unthreaded guide hole | 5, 5A |
| 526 | tapped attachment holes | 5, 5A |
| 528 | inner brace | 4B, 5, 5A |
| 530 | outer brace | 4B, 5, 5A |
| 532 | attachment screws | 4B, 5A |
| 534 | space | 4B, 5 |
| 610 | circulator-drive assembly | 6, 6D, 6E, 6F, 6G, 10 |
| 612 | circulator-arm support | 1, 1A, 1B, 6, 6I, 6J, 6K |
| 613 | spacer nuts | 6I, 6J |
| 614 | drive shaft | 6E, 6F, 10, 11 |
| 615 | slide screw | 6I, 6J |
| 616 | drive link | 6E, 6F, 6G, 6H |
| 617 | circulator-arm spacer | 6J |
| 618 | drive pin | 6B, 6E, 6F, 6G, 6A, |
| 619 | wing nut | 6I, 6J |
| 620 | drive shaft locking screw assembly | 6E, 6F, 6G, 6H |
| 621 | lock nut | 6G |
| 622 | drive shaft guide | 6E, 6F, 7 |
| 623 | holding nut | 6G |
| 624 | circulator arm | 6E, 6F, 6G, 6, 6A, 6B, 10, 11 |
| 625 | square opening | 6E, 6H |
| 626 | fulcrum screw | 6I, 6J, 6A, 10 |
| 627 | drive-pin hole | 6H |
| 628 | x-adjuster | 6I, 6J |
| 629 | x-adjuster slide bar | 6I, 6J |
| 630 | casting rotation motor | 1B, 6, 6D-2 |
| 631 | support block | 6J, 9 |
| 632 | circulation motor | 1B, 6, 6D-1, 7 |
| 633 | clearance cutout | 6B |
| 634 | fulcrum slot | 6B |
| 635 | stiffening bar | 6E, 6G |
| 636 | circulator motor square shaft hole | 6D-1, 6D-2 |
| 637 | drive-shaft upper end | 6F |
| 638 | square socket | 6D-2 |
| 640 | rotator motor support | 6, 6A, 6B, 10 |
| 641 | pipe union | 6C |
| 642 | casting screw sleeve | 6, 6A, 6B, 6C |
| 643 | pipe nipple | 6C |
| 644 | x-direction | 10 |
| 645 | washer | 6C |
| 710 | support box | 7 |
| 712 | horizontal position screw | 7 |
| 714 | handle | 7, 7B |
| 716 | brace | 7 |
| 718 | left travel nut | 7 |
| 720 | right travel nut | 7 |
| 722 | travel brace | 7 |
| 724 | travel brace | 7 |
| 726 | travel guide | 7 |
| 728 | travel guide | 7 |
| 730 | slide slot | 7A |
| 732 | slide washer | 7A |
| 734 | slide bolt | 7A |
| 736 | support structure | 7A, 7B |
| 810 | casting tray | 8A, 8B, 8C, 8D, 8E, 8F |
| 812 | casting tray rim | 8A |
| 814 | putty tape sealer | 8A |
| 816 | plastic bucket | 8 |
| 818 | mold ring | 8, 8B, 8C |
| 820 | water layer | 8D, 8G |
| 822 | wax layer | 8E, 8F, 8G |
| 824 | tie studs | 8F, 8G |
| 826 | weight | 8G |

-continued

| ITEM # | ITEM NAME | FIGURE # |
|---|---|---|
| 828 | casting cement | 8G |
| 830 | stud-insertion fixture | 8F, 8G, 8H |
| 832 | fixture guide | 8H, 8G |
| 834 | stud-insertion disc | 8H |
| 836 | lifting-stud holes | 8H |
| 1202 | outer bump pattern | 12A |
| 1204 | circulator pattern | 12A |
| 1206 | pattern band | 12A |
| 1208 | pattern band for support box 710 full left | 12B |
| 1210 | pattern band for support box 710 full right | 12B |
| 1212 | circulator pattern for support box full right. | 12B |
| 1214 | circulator pattern for support box full left | 12B |

DETAILED DESCRIPTION OF THE PREFERRED EMBODIMENTS

The vibratory polisher system shown in perspective view in FIG. 1 comprises six sub-systems:

casting 110
polish pan assembly 120
base assembly 130
vibrating table assy. 135 (not a part of this invention).
pan bracket assembly (simplified) 140
circulator system 150
horizontal slide assembly 160

Figure 1A:
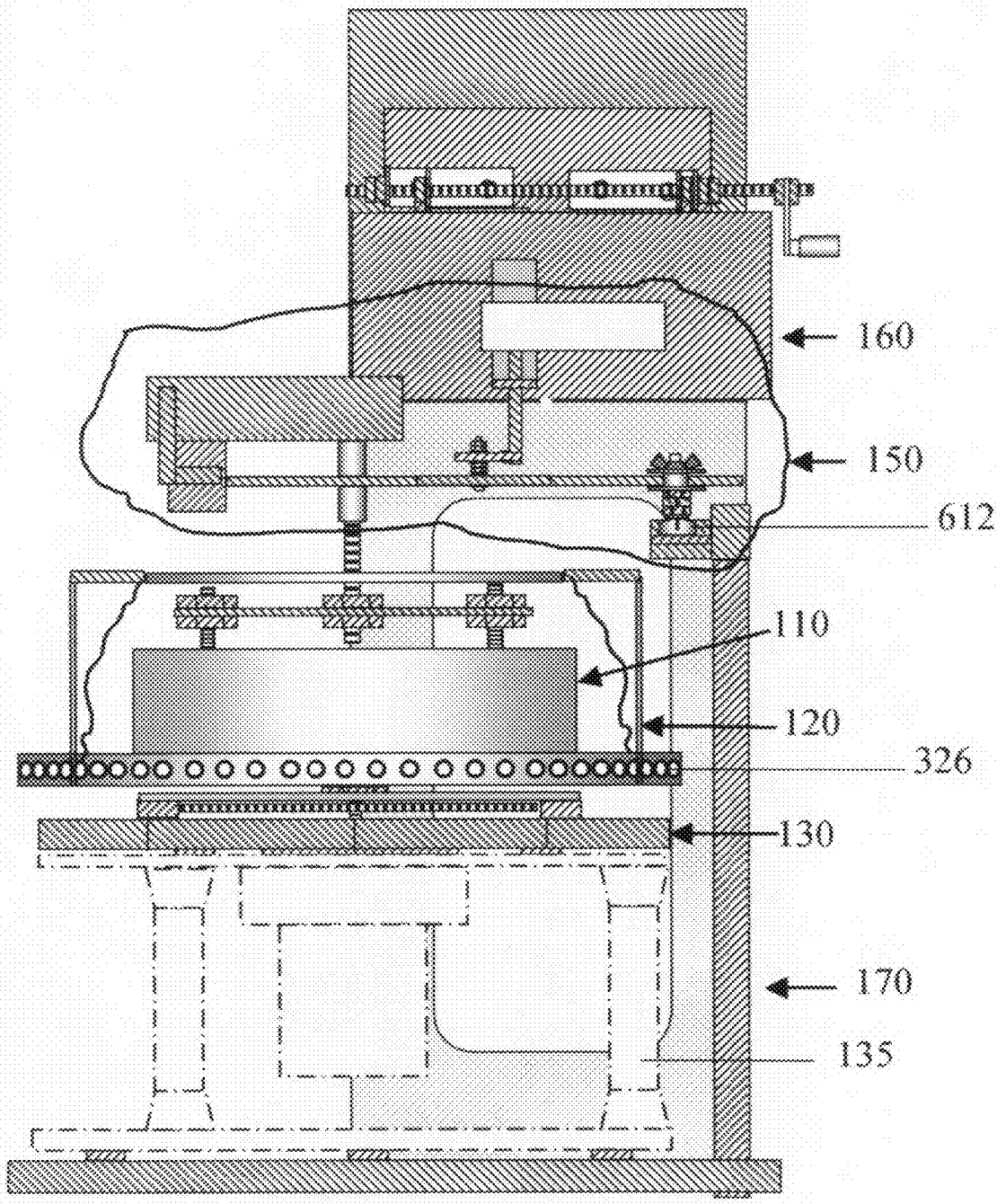
FIG. 1A is a simplified front view of the complete gemstone flat polisher mechanized.
Figure 1B:
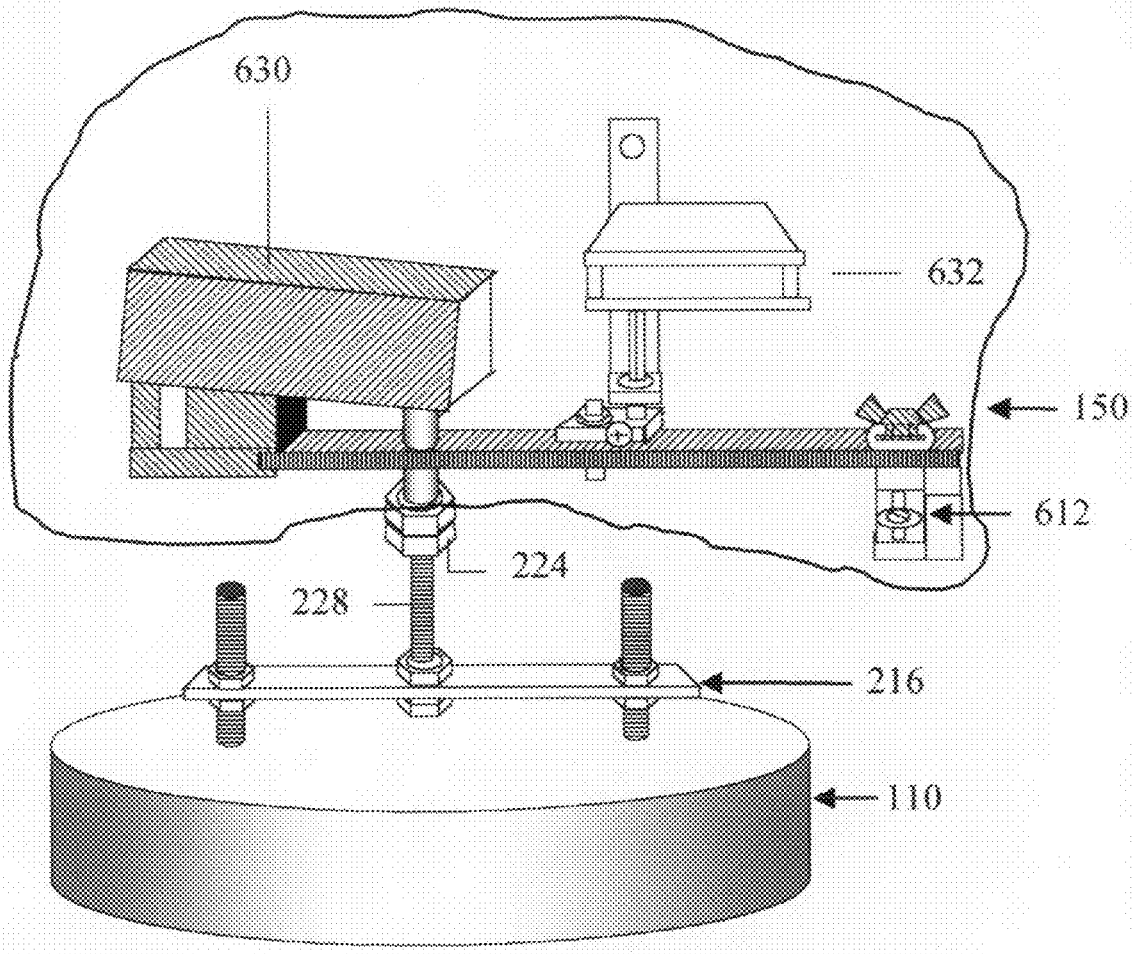
FIG. 1B shows an isolated view of the casting connected to the circulator system.

FIG. 1A shows the system of FIG. 1 in isometric front view. The front of the polish pan 120 has been cutaway to allow direct viewing of the casting 110 in the polish pan. FIG. 1B shows an isolated view of casting 110 and circulator system 150.

Casting

Figure 2:
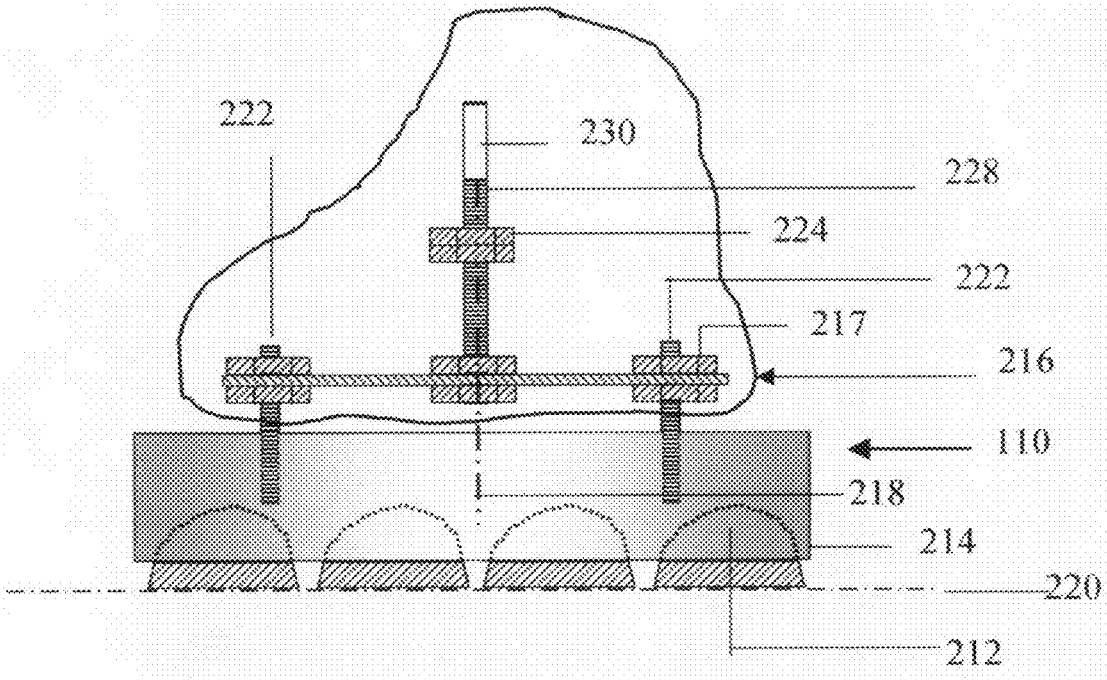
FIG. 2 shows a front view of the casting with its associated casting rotation fixture.
Figure 2A:
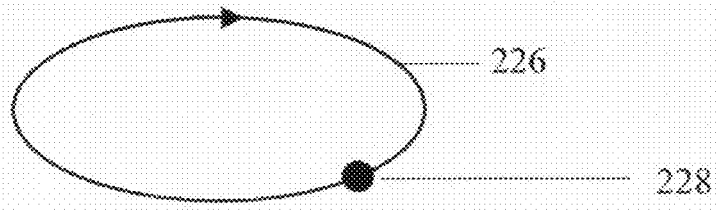
FIG. 2A shows a circulation pattern of the center-axis of the casting.

A casting 110 shown in FIG. 2 comprised of flat-bottomed rocks 212 cemented into a disc 214 is constructed. See method in Operation section. The flat surfaces of the flat-bottomed rocks form the casting plane surface 220 shown dash-dotted on the bottom of the disc 214. When the casting 110 is installed in the polish-pan 120, the casting plane surface 220 is in contact with polish pad 316 on the pan bottom. See FIG. 3. The lower surface of the bottom of pan 120 rests on the outer bump bolts 412 as may be seen in FIG. 4C. The casting has a center-axis 218 which is in the center of the circle that forms the outer edge of the casting. See FIG. 2. Casting rotation fixture 216 is connected to the casting by two lifting studs 222 and four height-adjustment nuts 217. Lifting studs 222 are embedded in cementing material and are equidistant from the center axis 218. The top-section 230 of casting rotation screw 228 has a square cross-sectional area. The square cross-section of top section 230 of the casting-rotation screw 228 slides into square socket 638 of the casting rotation motor 630. This may be seen in FIG. 6D-2. FIG. 2A shows the elliptical pattern described by center-axis 218 as the casting circulates propelled by circulator motor 632.

Polish Pan

Figure 3:
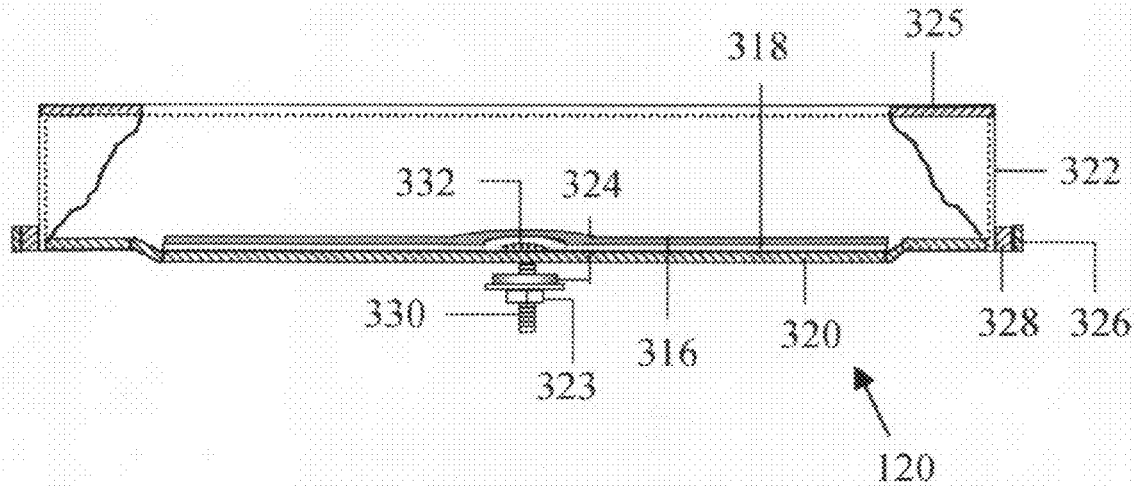
FIG. 3 is a cutaway side-view of the polishing pan with its attached center-bump bolt.

Polish Pan Bottom and Lining, FIG. 3

A special pan 120 in FIG. 3 has a pan-bottom 320 constructed of a rust-resistant flexible metal or stiff plastic. The pan-bottom 320 has an upperside and an underside. The first embodiment for the pan-bottom 320 uses a flexible copper pan. A polish pad underlayer of plastic 318 is cemented to the upperside of the pan-bottom 320. The first embodiment for underlayer 318 is comprised of plastic table setting pads cut to fit the polish pan and cemented to the upperside of the pan bottom. Polish pad 316 comprising a layer of rough textured cloth-like material is cemented to the top of the polish-pad underlayer 318. The first embodiment for the polish-pad 316 is indoor-outdoor carpeting.

Figure 3A:
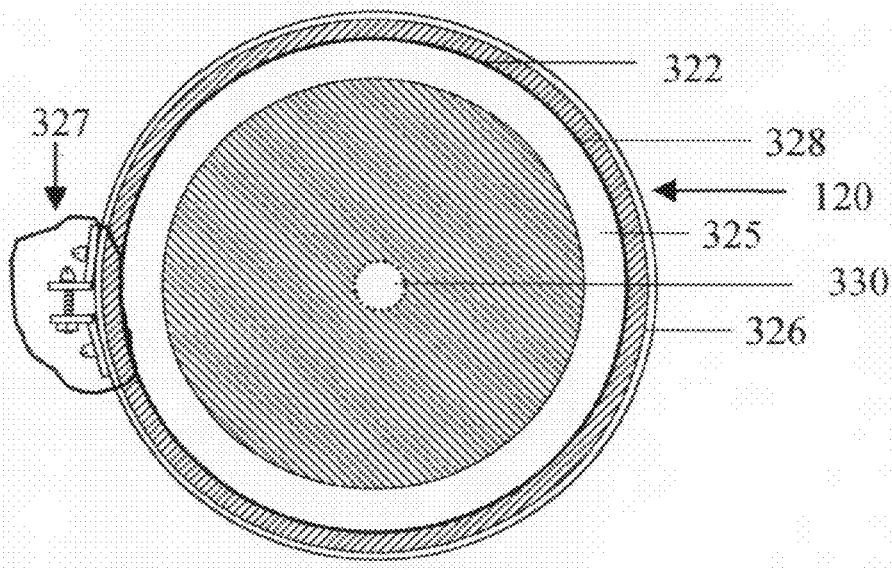
FIG. 3A is a top-view of the polish-pan assembly.

Polish Pan Sides, FIGS. 3 and 3A.

The polish pan 120 is surrounded by thin vertical aluminum or galvanized sheet metal pan sides 322. Aluminum is the first embodiment for the pan sides 322. The polish pan has a splash rim 325 around the inner top of the sides to restrict splash. This can be best seen in the cutaway view FIG. 3 and in top-view FIG. 3A. A stretched retainer band 326 surrounds a wooden circle retainer ring 328 to provide a seal around the pan edges. Retainer-band lock 327 connects the two ends of retainer band 326. The retainer band 326 may be seen in FIG. 3A and also in FIG. 1A. Retainer-band lock 327 is not shown in FIG. 1A.

Center-Bump Bolt, FIG. 3

A center-bump bolt 330 passes through a hole in the polish pan bottom and is sealed using a nut-washer 323 and o-ring 324 which are shown in the loosened condition in FIG. 3. The center-bump bolt head 332 inside the pan is ground down to a lens shape so that the center bump is very smooth and low. The center-bump bolt 330 is made of corrosion-resistant material. The first embodiment material for the center-bump bolt 330 is brass. The center-bump bolt-head 332 is under polish-pad 316 and polish-pad underlayer 318 as seen in FIG. 3.

Figure 4:
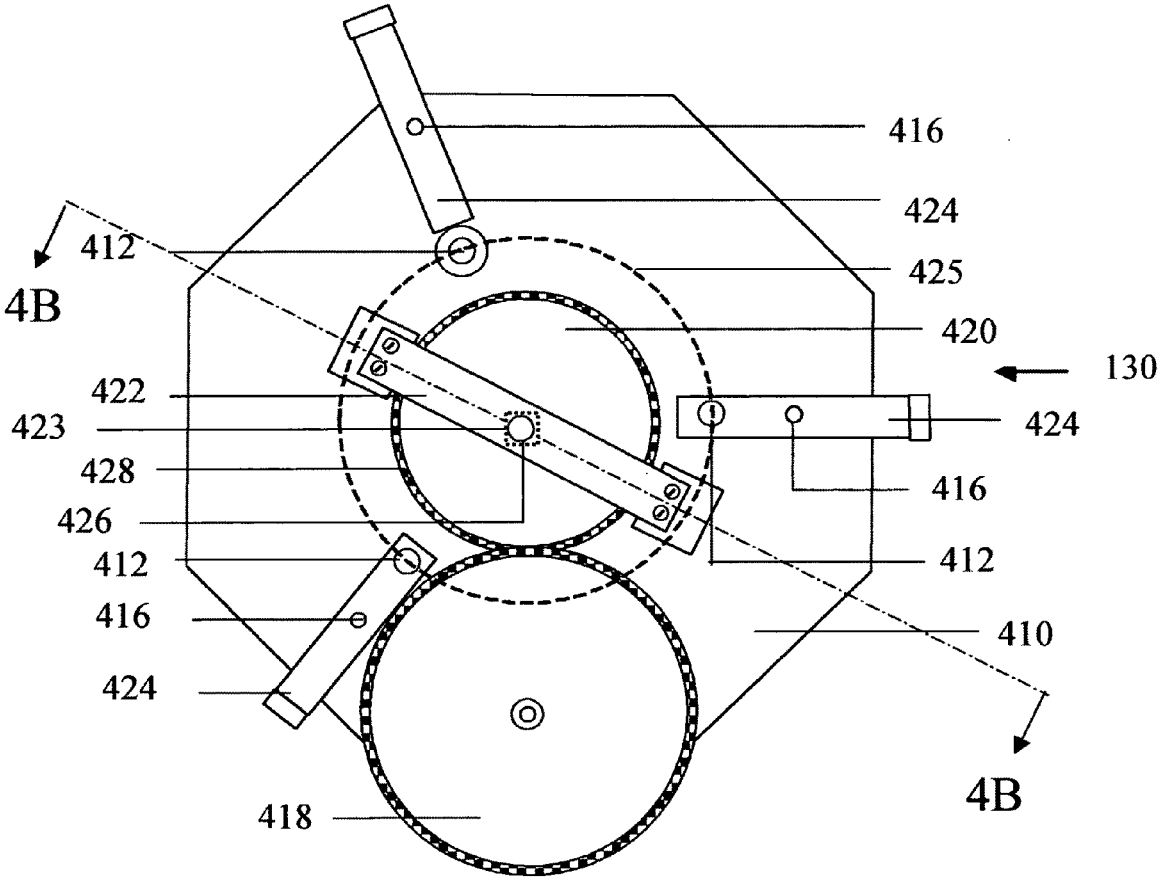
FIG. 4 shows a top-view of the base assembly.
Figure 4A:
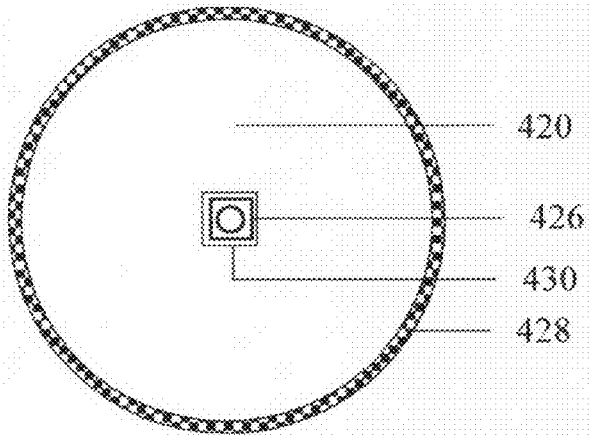
FIG. 4A shows a top-view of the base assembly driven gear.
Figure 4B:
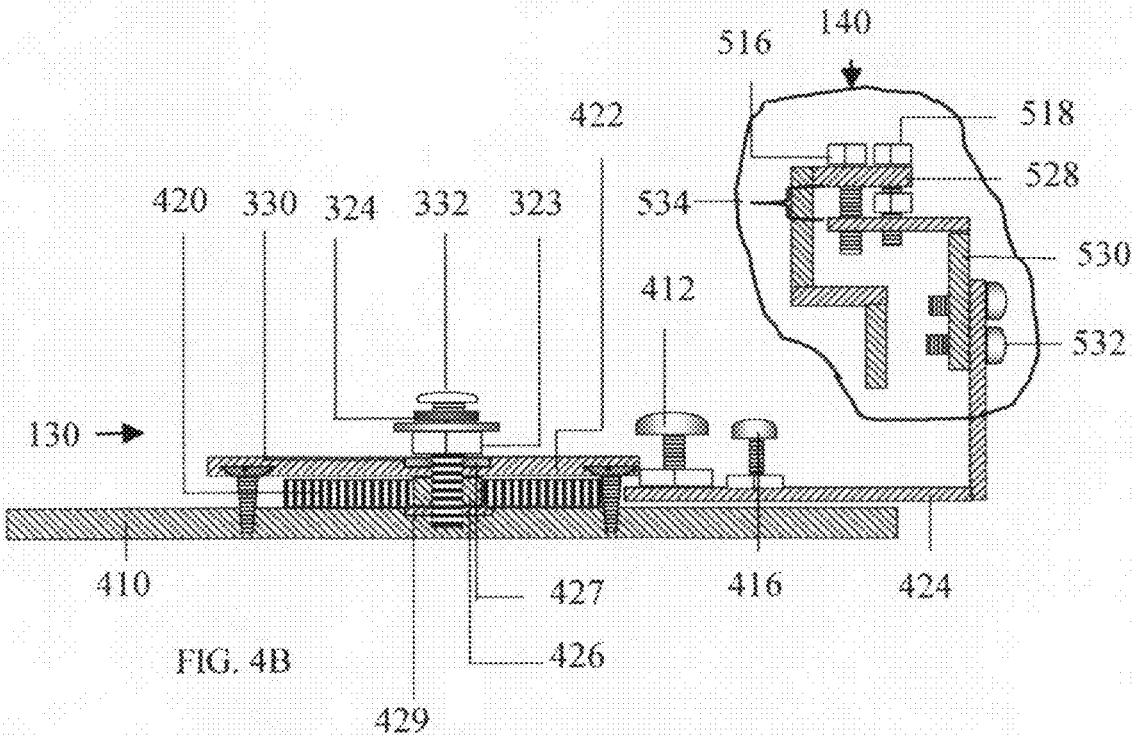
FIG. 4B is a side-view of the base assembly with an attached pan-bracket assembly.

Base Assembly 130, See FIGS. 4, 4A, & 4B.

Base Board, FIG. 4

A base assembly 130 is shown in top-view in FIG. 4. Base board 410 is constructed of flat, sturdy, light-weight material, equipped with three or more outer bump bolts 412 that protrude vertically upward through the base material. Outer bump bolts 412 may also be seen in side-view in FIG. 4B. Only one bolt is shown. The preferred embodiment of the base board 410 uses ¾" plywood for the base material. The outer bump bolts 412 comprise rounded-head carriage or step-bolts and are arranged approximately equally spaced in a pulldown-bolt circle 425 about the center of the base board. The first embodiment of the number of bolt-heads is three. Three heads provide a more certain pressure from the casting on each head than 4 or more heads. The heads of the outer bump bolts 412 press against the flexible polish-pan bottom 320 and provide elevated portions in the bottom.

Gears, FIGS. 4 and 4A.

Gears 418 and 420 attach to the baseboard 410 with rotatable attachment means. Gear 418 is the driving gear and gear 420 is the driven gear. Gear 418 is positioned by hand. Driving-gear 418 has approximately 72 teeth and a diameter of 7.75 inches in the first embodiment. A gear hold-down bar 422 is provided to hold the driven gear 420 down.

Hole, 423.

Gear hold-down bar 422 in FIGS. 4 & 4B has a hole 423 in its center and is installed above square nut 426 and driven-gear 420 which are shown in FIG. 4A. A counterbore washer 427 is counterbored flush into gear hold-down bar 422 to support nut-washer 323. The threaded portion of center-bump bolt 330 of FIG. 3 screws into square nut 426 when polish pan 120 is installed on the base-assembly 130. See also FIG. 9.

Driven Gear 420, FIG. 4A

FIG. 4A shows a plan view of the driven gear 420. The driven gear has a square hole 430 cut in the center to accomodate a square nut 426. The driven gear 420 has teeth 428 cut around its periphery. In the first embodiment, driven-gear 420 has 50 teeth and a diameter of 6 inches.

Pan Bracket Attachments, FIGS. 4, 4B.

Pan bracket attachments 424 are provided at three or more locations around the periphery of the base 410. See FIG. 4. The first embodiment uses three pan-bracket attachments 424. Pan bracket assemblies 140 shown in FIG. 5 attach to the pan bracket attachments 424, one pan bracket assembly 140 to each pan bracket attachment 424. This may also be seen in FIG. 4A only one of which is shown.

Base Assembly, Side View With Pan Bracket Assembly Attached. FIG. 4B.

FIG. 4B is a side view of the base assembly 130 with one of the three pan-bracket assemblies 140 attached. It shows a cutaway view of the center-bump bolt 332 passing into the square nut 426 in the center of driven gear 420.

Pan Bracket Assembly 4B, 4C, 5&5A.

Figure 4C:
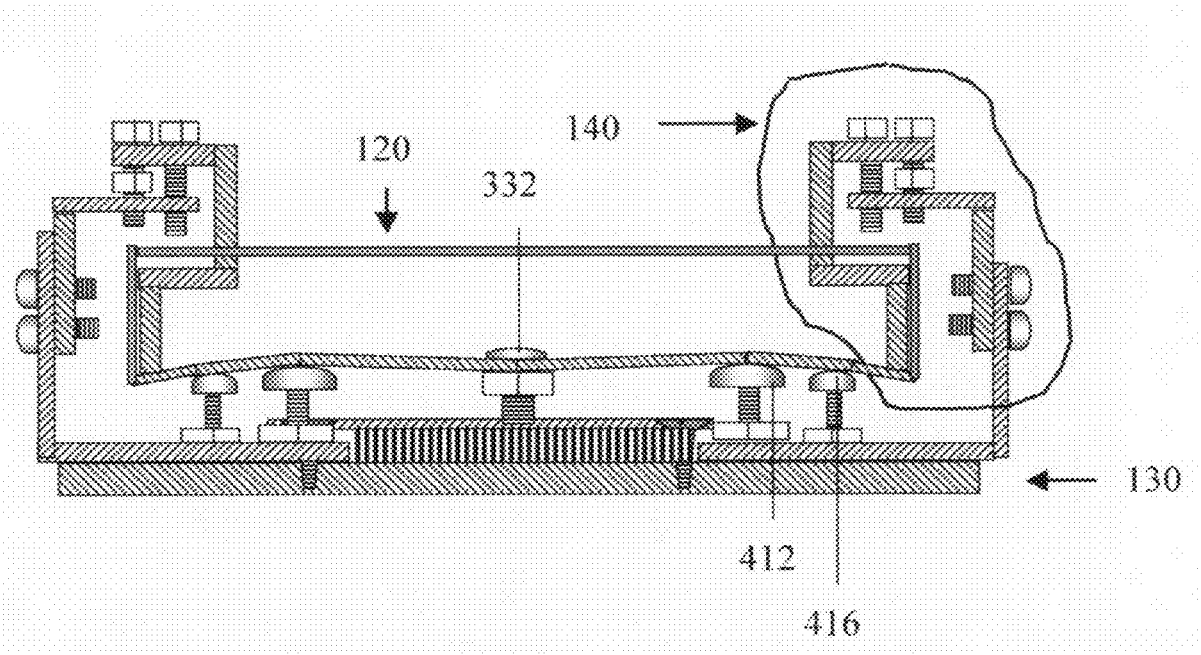
FIG. 4C is the same as FIG. 4B but with the polish-pan included.
Figure 5:
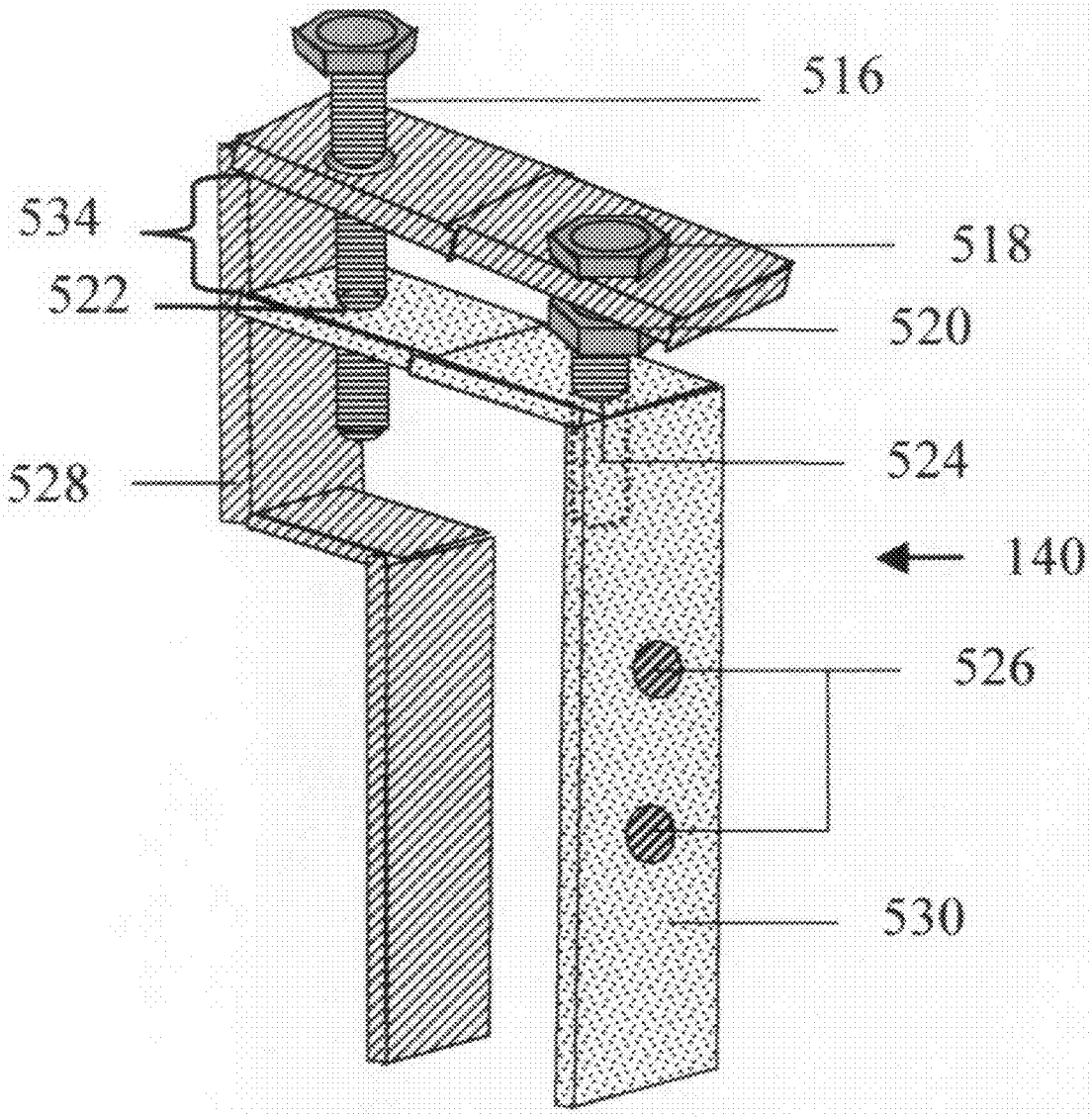
FIG. 5 is a perspective view of the pan-bracket assembly.
Figure 5A:
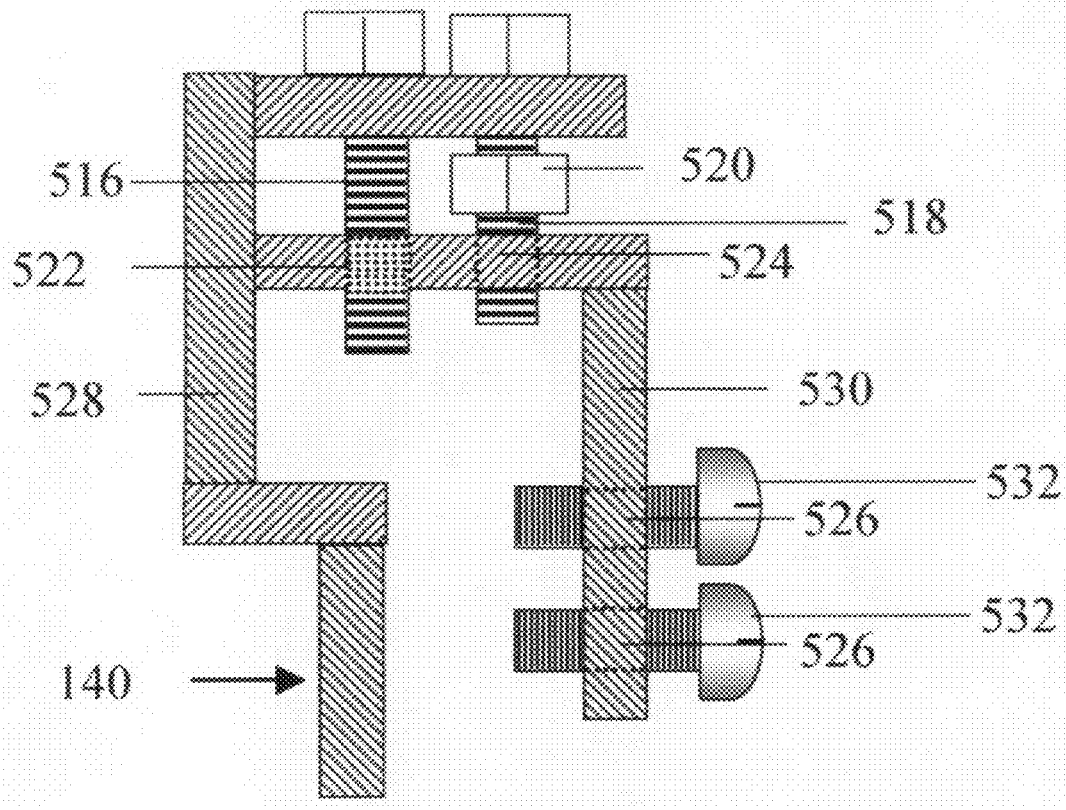
FIG. 5A is a side-view of the pan-bracket assembly.

The polish pan is held down by three pan-bracket assemblies 140 one of which may be seen in FIGS. 5 & 5A. Two pan bracket assemblies are shown installed in FIG. 4C. The pan bracket assemblies 140 are positioned at three approximately equally spaced locations around the center of base-board 410 at the pan-bracket attachment positions 424. The three pan attachment positions may best be seen in FIG. 4. Outer brace 530 in FIGS. 4B and 5 is attached to the pan-bracket attachment 424. Inner brace 528 is attached to outer brace 530 by a pulldown bolt 516 as in FIGS. 4B and 5. Guide bolt 518 passes through unthreaded guide hole 524.

Pan Bottom Curvature, FIG. 4C.

When the pan bracket assemblies 140 are installed and tightened, the pan-bottom takes on the shape shown in FIG. 4C. Center bump 332 holds down the pan-center while the pan bracket assemblies 140 hold down the outer pan edges against the limit bolts 416.

Figure 7:
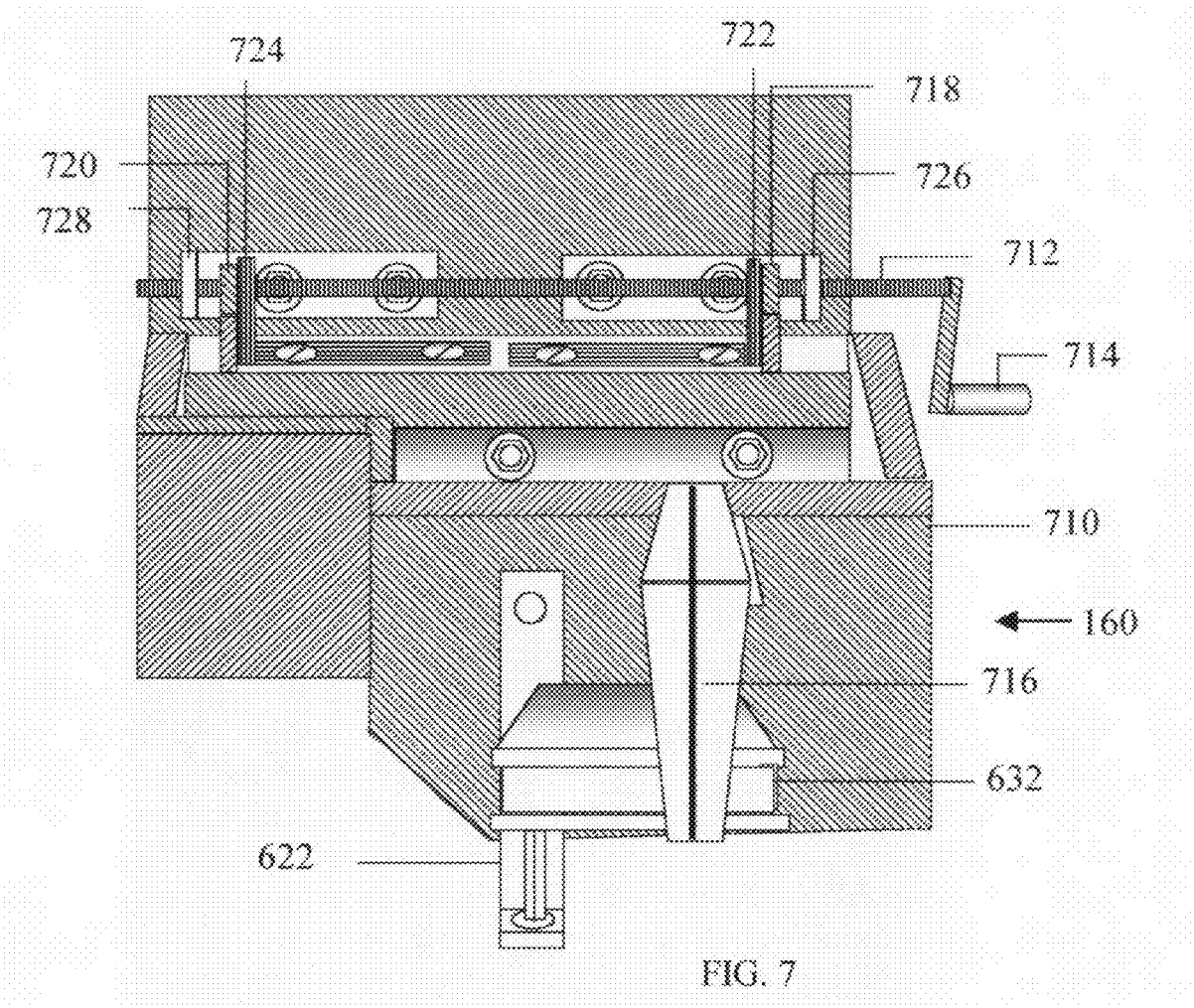
FIG. 7 shows the horizontal-slide assembly in perspective view.
Figure 7A:
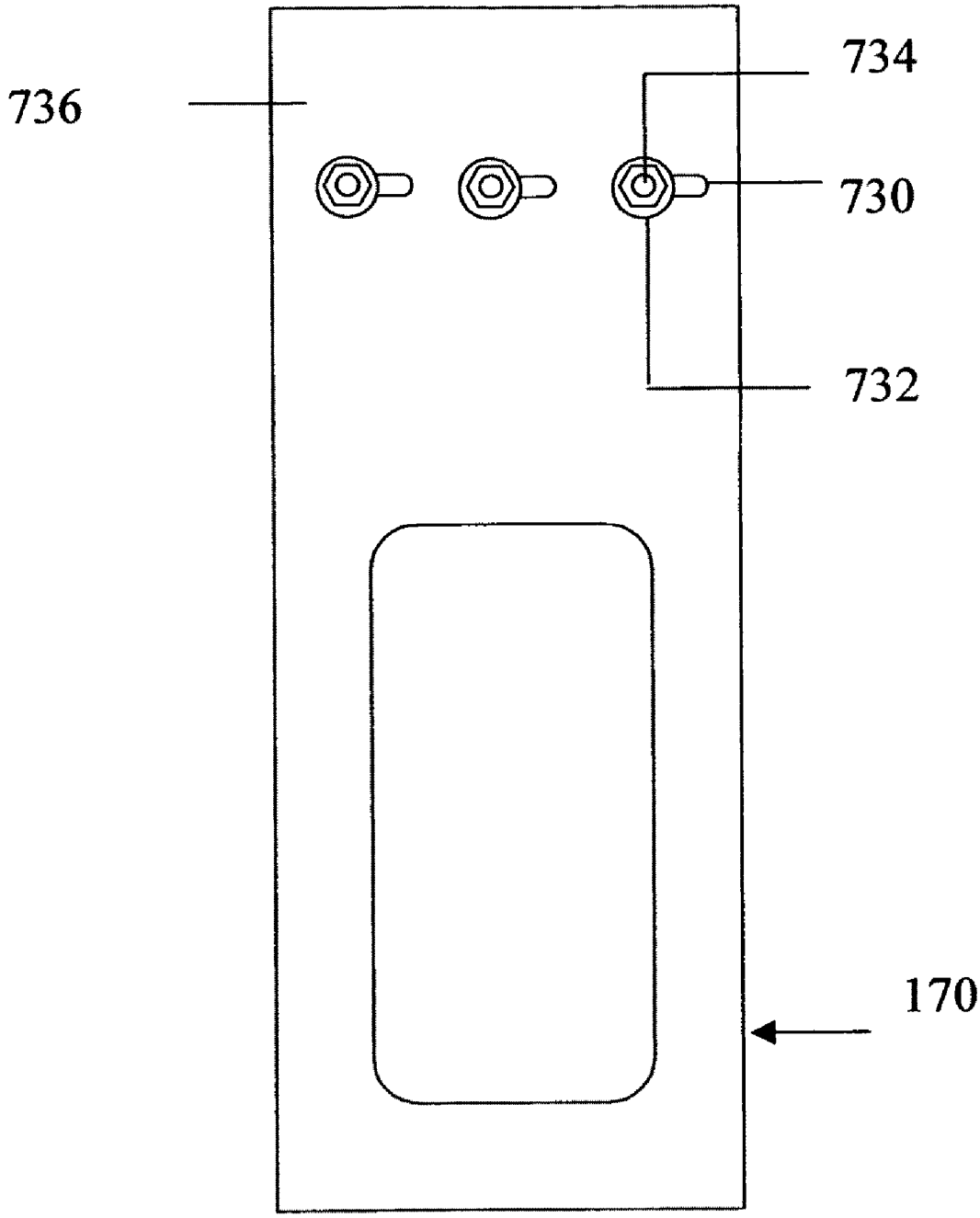
FIG. 7A shows the support-structure from the back.
Figure 7B:
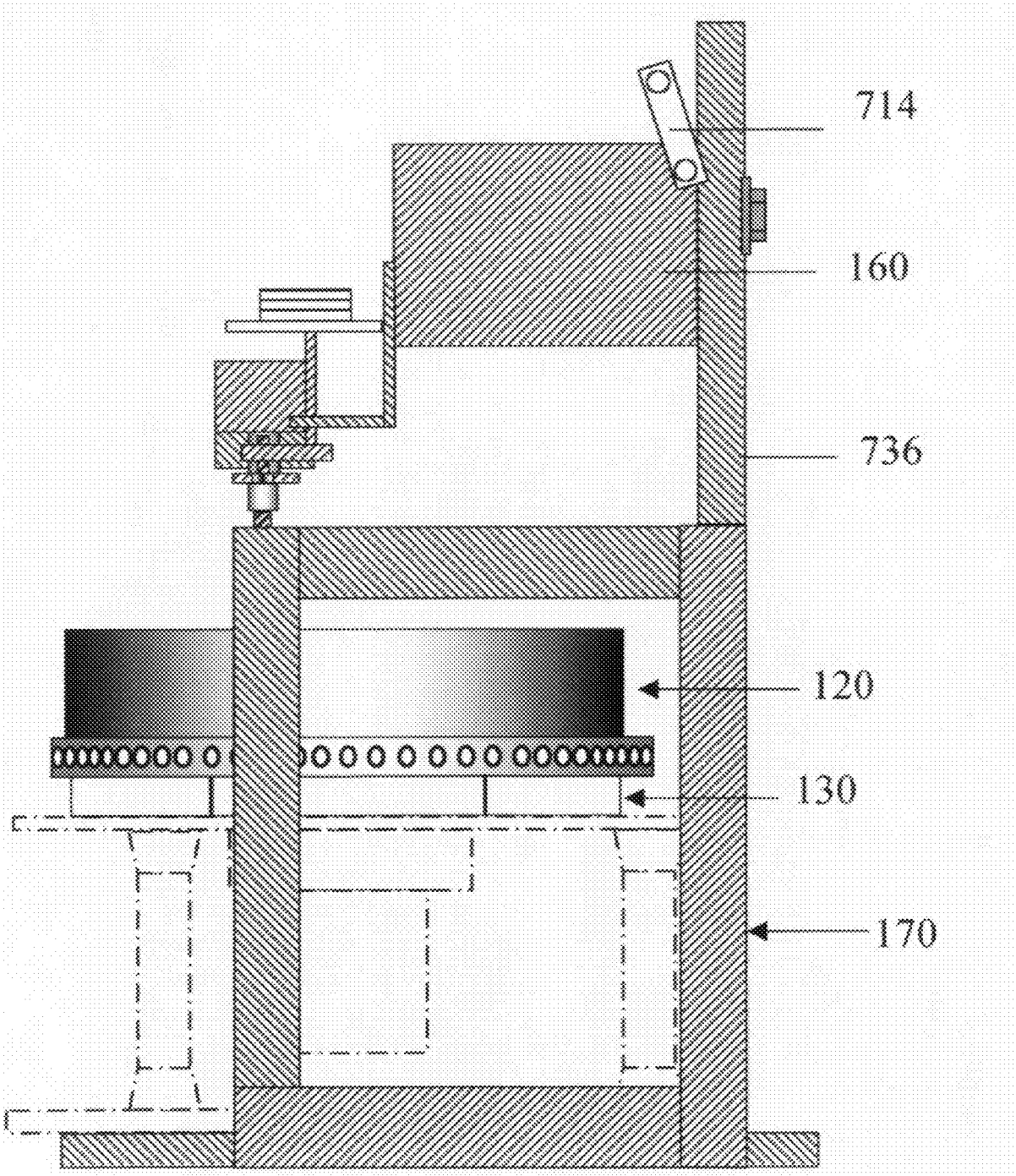
FIG. 7B shows the gemstone flat polisher mechanized from the side in abbreviated form.

Vibrating Table, FIGS. 1A and 7B.

The base assembly 130 rests on a vibrating table 135 (broken lines) shown in FIGS. 1A and 7B which is part of a vibrating lap assembly. This assembly is available from lapidary equipment dealers. Only the vibrating table assembly 135 itself is used in this invention but is not a part of the invention. The vibrating table supplies vibration to the base-assembly 130. The vibration is transmitted via the base-assembly to the polish-pan 120. The lap-pan usually supplied by the manufacturer with the vibrating table is not used in this invention. The vibrating table is available from Covington Engineering, Redlands, Calif.

Figure 6:
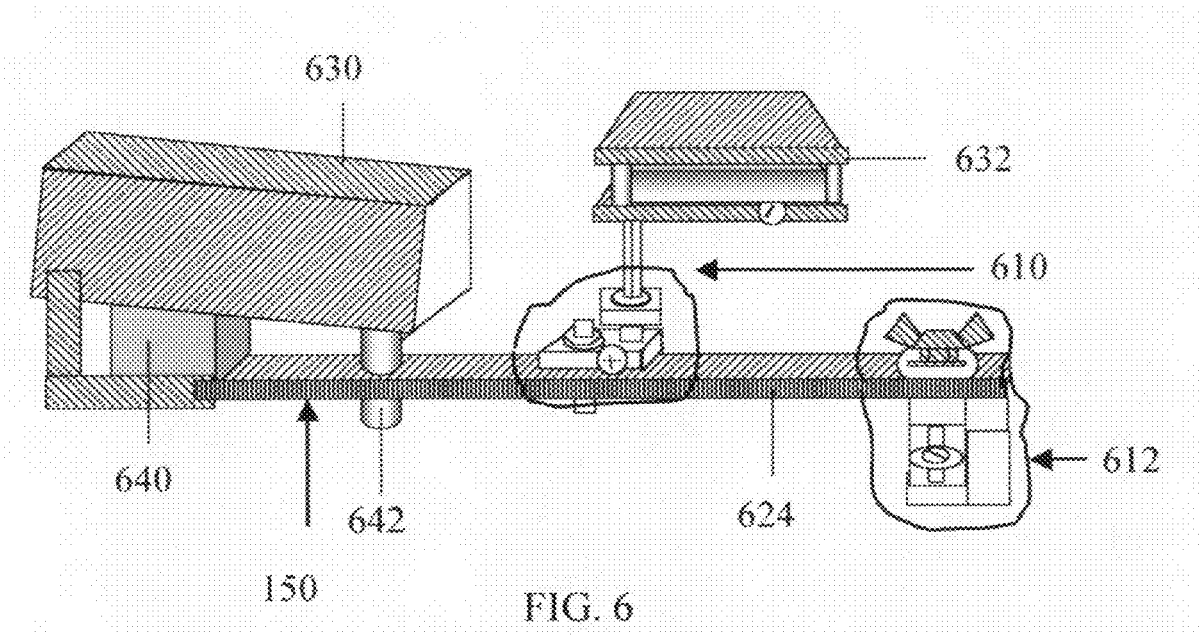
FIG. 6 shows the circulator-drive assembly in perspective view.
Figure 6A:
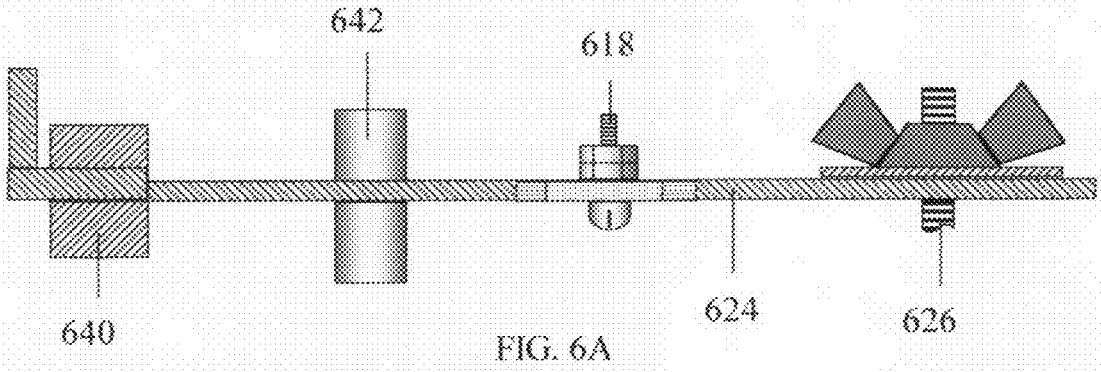
FIG. 6A shows the circulator arm and attachments in side-view.
Figure 6B:
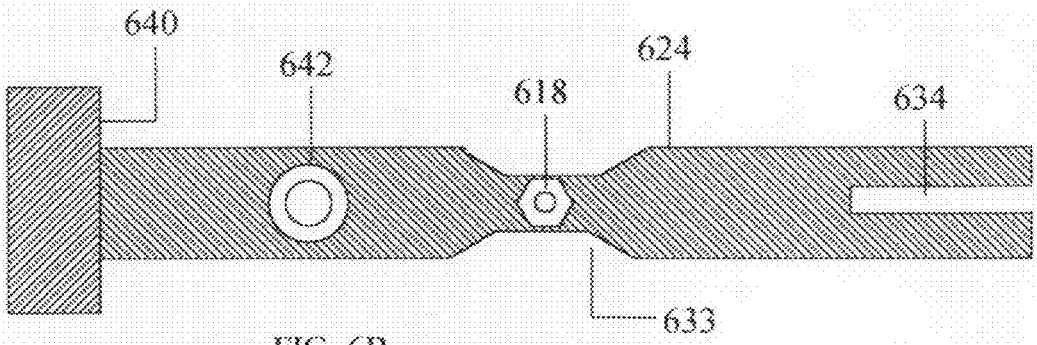
FIG. 6B shows the basic circulator arm in top-view.

Circulator System 150, FIGS. 6,6A,6B.

Figure 6C:
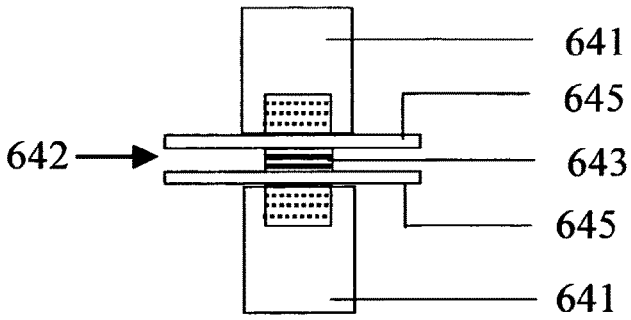
FIG. 6C shows the casting-screw sleeve in side-view.
Figures 1, 6D:
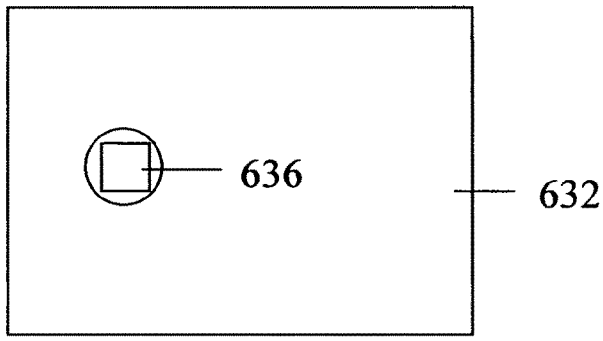
Figures 2, 6D:
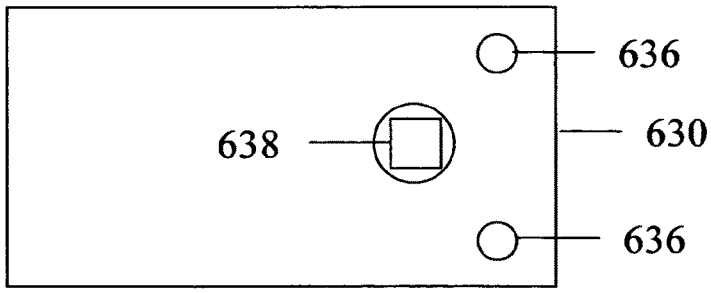

Circulator system 150 in FIG. 6 comprises a rotator motor 630, a circulator motor 632, a circulator arm 624, a circulator-drive assembly 610, a circulator-arm support 612, and rotator motor support 640. The circulator arm 624 provides a connection between the circulator drive assembly 610, casting rotation screw sleeve 642, the rotator motor support 640, and circulator arm support 612. FIG. 6C shows that casting-screw sleeve 642 is comprised of one pipe nipple 643 and two pipe unions 641. One pipe union 641 is attached to each end of pipe-nipple 643. Washers 645 are placed one on each side of circulator-arm 624. The pipe-unions 641 are screwed onto pipe-nipple 643. FIG. 6A is a side-view of circulator arm 624 with its attached hardware. FIG. 6B shows the basic design of circulator arm 624 in top view.

Circulator-Drive Assembly 610, FIGS. 6E,6F,6G and 6H.

Figure 6E:
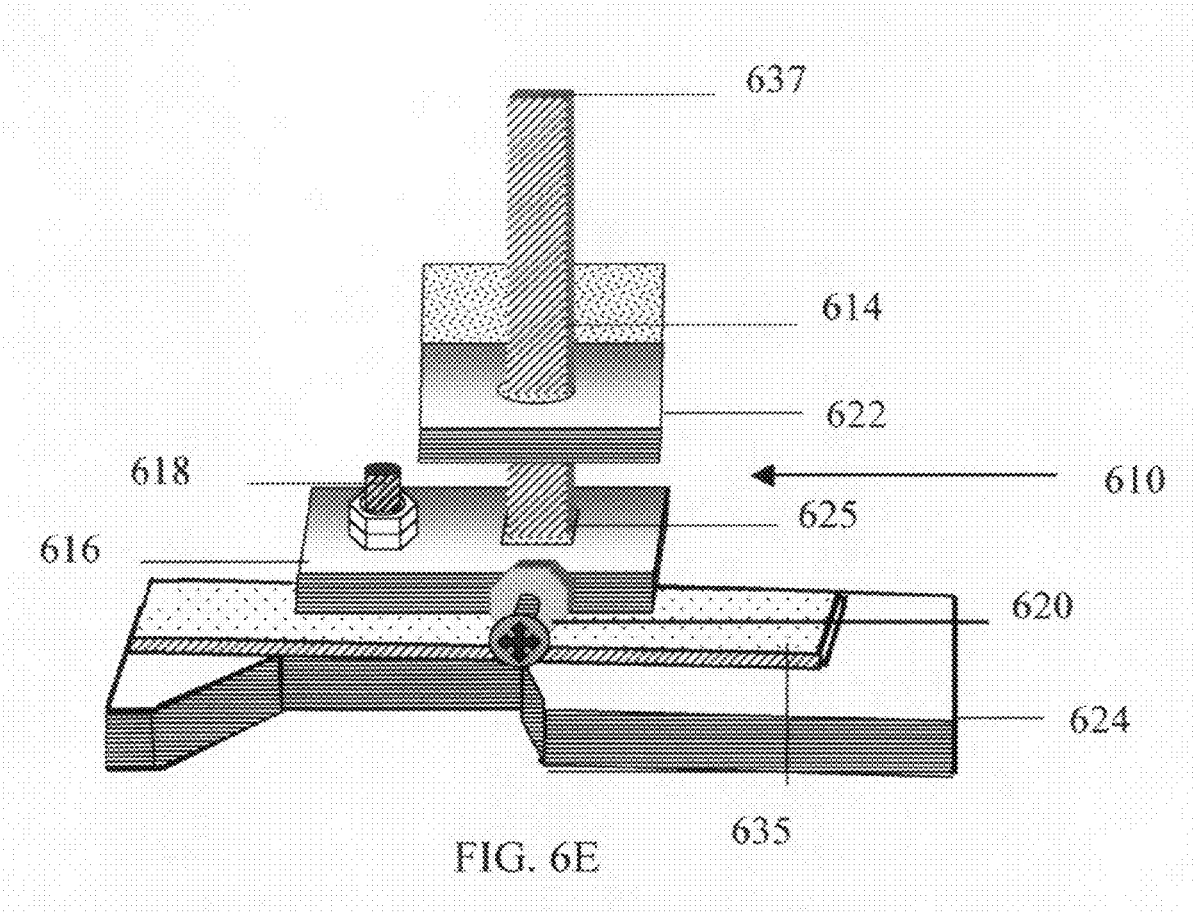
FIG. 6E shows the circulator-drive assembly in perspective view.
Figure 6F:
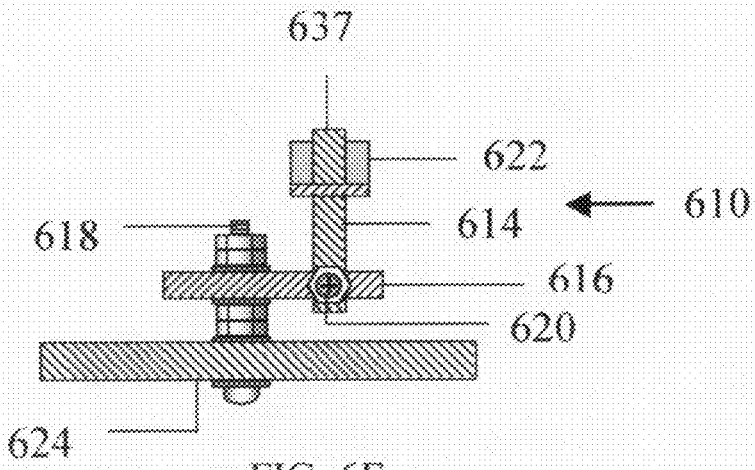
FIG. 6F shows the circulator-drive assembly in side-view.
Figure 6G:
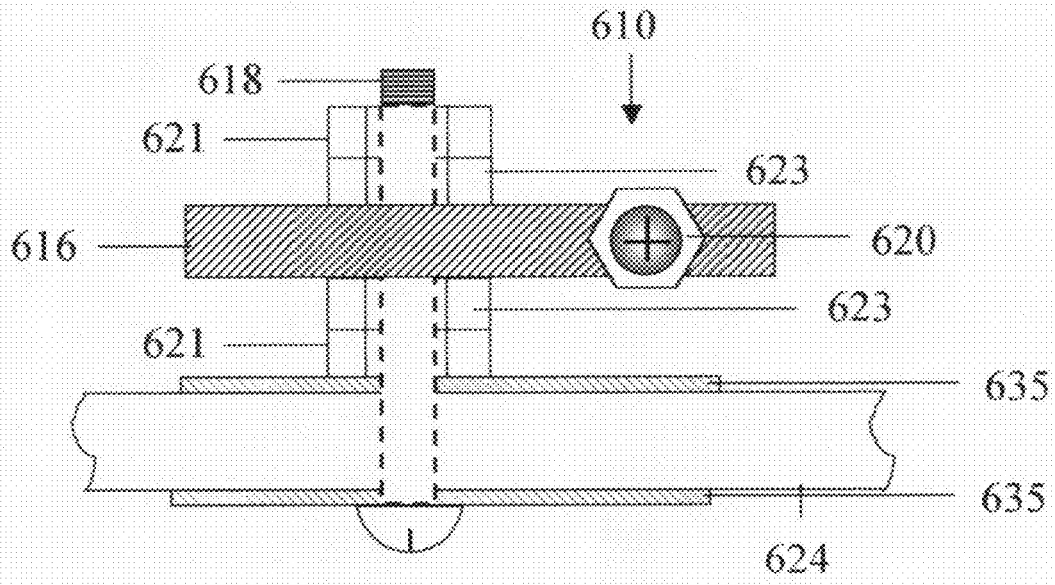
FIG. 6G shows the circulator-drive assembly in magnified form.
Figure 6H:
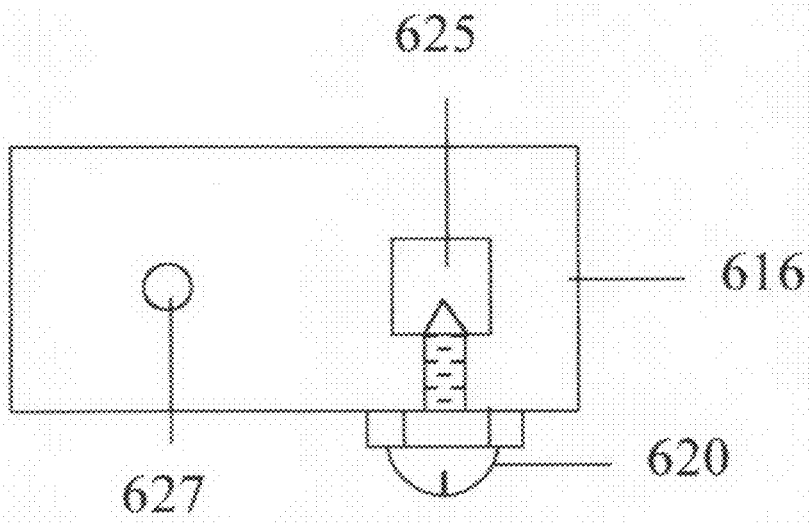
FIG. 6H shows the drive-link in top-view.

FIG. 6E shows circulator-drive assembly 610 in perspective view. This is a magnified view of the section 610 shown in FIG. 6. FIG. 6F shows circulator-drive assembly 610 in side view. Drive shaft 614 passes through drive-shaft guide 622 and is connected at its upper end 637 to square shaft hole in circulator motor 632. The drive-shaft guide 622 is attached to support box 710. This may best be seen in FIG. 7. In FIG. 6E, drive shaft 614 enters square opening 625 in drive-link 616 and is held in place by drive-shaft locking screw assembly 620. This is shown in top-view in FIG. 6H. Drive-link 616 is attached to drive pin 618. Drive-pin 618 is attached to circulator-arm 624. FIG. 6E shows that a stiffening bar 635 is fastened to circulator-arm 624. This is shown only in FIGS. 6E and 6G for simplicity. FIG. 6G shows that there is a stiffening bar 635 on each surface of circulator-arm 624. FIG. 6G is an enlarged side-view of the circulator-drive assembly 610 showing the holding nuts 623 and the lock nuts 621. Holding nuts 623 are clamped loosely to circulator arm 624 to allow free motion of drive link 616. FIG. 6H is a top view of drive-link 616. The drive-link 616 has a square opening 625 and a pointed locking screw assembly 620 which comprises a pointed machine screw and lock nut.

Figure 6I:
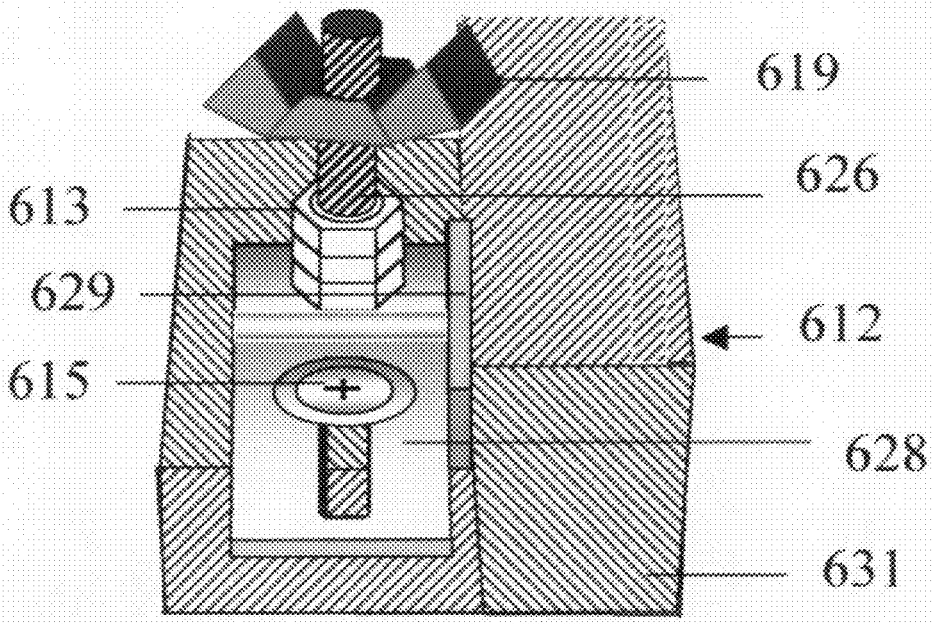
FIG. 6I shows the circulator-arm support in perspective view.
Figure 6J:
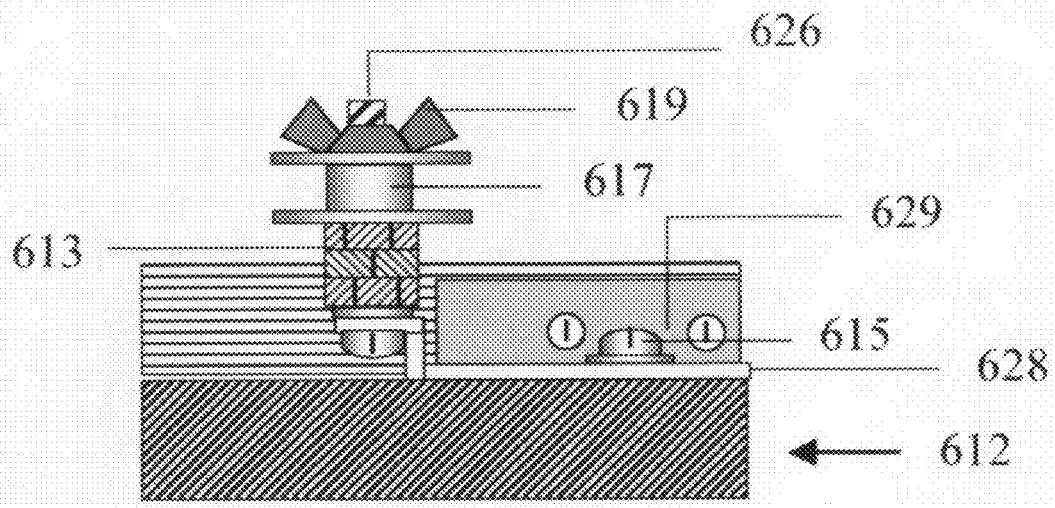
FIG. 6J shows the circulator-arm support in side-view.

Circulator-Arm Support 612, FIGS. 6I & 6J.

Figure 6K:
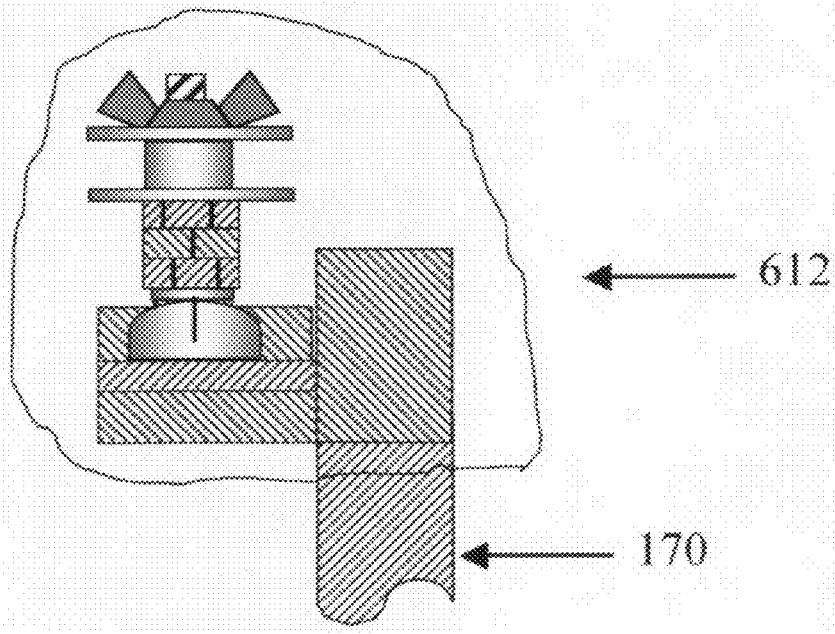
FIG. 6K shows a simplified front-view of the circulator-arm support.

Circulator-Arm Support 612 may be seen in its position in FIGS. 1, 1A, 1B, & 6. FIG. 1B shows circulator system 150 isolated with the casting 110 attached. In FIG. 6I, spacer nuts 613 connect fulcrum screw 626 to X-adjuster 628. Circulator-arm spacer 617 in FIG. 6J and its washers are not shown in FIG. 6I for clarity. They are shown in side-view in FIG. 6J. Slide screw 615 attaches X-adjuster 628 to support block 631. X-adjuster 628 sits against X-adjuster Slide Bar 629. Circulator-arm support 612 is attached to support structure 170. This may be seen in FIGS. 1A, 6K & 7B.

Circulator Motor Support Box 710, FIG. 7

As shown in FIG. 7B, which is a view from the side of the vibrating lap polisher system, horizontal-slide assembly 160 is attached to support structure 170 and to support structure back 736. This attachment uses bolts 734 and slide-washers 732 as seen in FIG. 7A, which is a view of support structure back 736 as viewed from the back. Only one callout for bolt 734 and slot 730 are given on FIG. 7. In FIG. 7, circulator motor 632 is attached to the front of circulator motor support box 710. Brace 716 is connected between the circulator motor support box 710 and circulator motor 632. In FIG. 7, horizontal position screw 712 passes through right-travel nut 718 and through left-travel nut 720 and passes through unthreaded travel braces 722 and 724. Horizontal position screw 712 also passes through unthreaded travel guides 726 and 728. Handle 714 is attached to horizontal-position screw 712.

Figure 9:
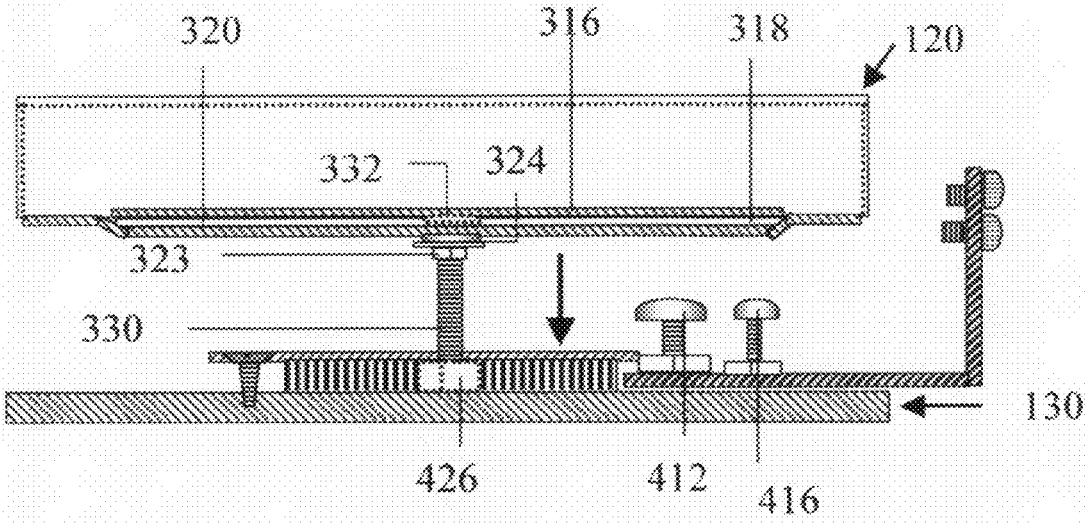
FIG. 9 shows a side-view of the polish-pan being attached to the base-assembly.

Operation of Vibrating Lap Polisher Comprises:

Attaching Polish Pan 120 to Base Assembly 130, FIG. 9.

Setting the polish pan 120 down onto the base assembly 130 as shown in FIG. 9, with the end of the center-bump bolt 330 in the center of square nut 426. See also FIG. 4A for the square nut. Rotating the entire polish pan 120 clockwise in a horizontal plane so that pan 120 approaches the base assembly 130 as a result of the threaded contact between center-bump bolt 330 and square-nut 426. The vertical black arrow in FIG. 9 shows how the polish-pan bottom 320 approaches the base assembly 130. The foregoing process may also be obtained by rotating driving gear 418 of FIG. 4 clockwise.

Driven gear 420 then rotates counter-clockwise which causes square-nut 426 to be screwed onto center-bump bolt 330. The lowering pan will touch the tops of the outer bump bolts 412. The first embodiment envisions three outer carriage bolts 412, although more may be used. Step bolts may be used rather than carriage bolts. Three outer bump bolts provide a more certain contact of each bolt between portions of casting plane surface 220 and the three bolt-heads than a larger number of outer bump bolts when casting 110 is installed in polish pan 120.

Operation of Pan-Bracket Assembly 140.

Installing Pan Bracket Assemblies 140.

Refer to FIGS. 4B, 4C, 5, 5A, and 9. Installing pan-bracket assemblies 140 to pull the edges of polish pan 120 down under tension against the limit bolts 416 after the under-side of polish-pan-bottom 320 has made firm contact with the outer bump bolts 412. This results in the pan-bottom curvature shown in FIG. 4C. Pan-bracket assemblies 140 comprise two independent sections, outer brace 530, and inner brace 528. Installing pan-bracket assemblies 140 comprises fastening pan-bracket assembly 140 to the pan-bracket attachments 424 using attachment screws 532. The attachment screws 532 screw into tapped attachment holes 526 and are tightened. Inner brace 528 fits inside polish-pan 120 as shown in FIG. 4C. Three of the pan bracket assemblies 140 are used in the first embodiment, although more may be used. Tightening pulldown-bolt 516 to cause space 534 between inner brace 528 and outer-brace 530 to decrease. At the same time, guide-bolt 518 slides in unthreaded guide hole 524 to keep inner brace 528 and outer-brace 530 parallel. As pulldown-bolt 516 is tightened, the lower end of inner-brace 528 is lowered, causing a pressure on the inside bottom edge of polish-pan 120. This pressure creates raised areas in the pan-bottom due to force over the outer bump bolts 412. The tension created by the pan-bracket assemblies 140 continues to be increased as pulldown-bolt 516 is screwed until the underside of the polish-pan bottom touches the limit-bolts 416.

Preparation of Casting For Polish.

Installing casting-rotation fixture 216 and height-adjustment nuts 217 on lifting studs 222. See FIG. 2. Adjusting height-adjustment nuts 217 for proper mating between casting-rotation screw 228 and casting-screw sleeve 642 (FIG. 6) to cause circulator-arm 624 to be approximately level. Leveling nuts 224 on casting-rotation screw 228 have been preset to the correct height level (FIG. 1B). Checking casting plane surface 220 for flaking, holes, etc. Removing the flaking areas. Filling any holes with slightly heated paraffin wax, which is moldable. Being sure there are no areas in which grit has lodged from previous processing, and removing the grit. Wire-brushing any areas where grit may have lodged using a brass-bristle brush and a pressure nozzle. Doing this outdoors.

Preparation of Polish Pan Prior to Installation of Casting Into Polish-Pan.

Checking the polish pad 316 for excessive wear over the outer bump bolts. The polish-pan is used only for polish. Grit is never put into the polish pan. The pan can be rotated to a new position for the outer bumps. If there is excessive wear of the polish pad center over the center bump bolt head, the pad must be changed. If the center-bump is never raised more than necessary to isolate its effect, the pad will last a long period of time. Cleaning the pan of any contamination by vacuuming the pad. If there is water in the pan, the pan can be tipped forward to allow the water to collect in one area while the pad is vacuumed in another area.

Putting Water and Polish Into the Pan

The polish pan bottom 320 should be completely covered with water. There may still be polish in the pan from a previous polish cycle. This polish can be used, but also adding about ½ cup of polish to the pan. In the first embodiment, cerium oxide polish will be used. Turning the vibrating table assembly 135 on and brushing the polish around with a clean paintbrush.

Installing Casting Into Polish-Pan:

Setting the casting 110 into the polish-pan 120. Rocking the casting 110 to see if the pan-center height is correct. If there is no rocking or too much rocking, adjusting the center-bump bolt 330 using the driving gear 418 so that the casting 110 can be rocked slightly but not a great amount.

Operation of Base Assembly Comprises:

Operation of Gears

Gears 418 and 420 are provided to raise the center of polish pan 120 up or down as needed. Gear hold-down bar 422 is provided to hold the driven gear 420 down against the upward pressure created by the center-bump bolt 330 as the gears are turned, causing tension in the polish-pan-bottom 320. The gears 418 and 420 are needed because the center-bump bolt 330 cannot be reached for adjustment by hand during polishing. The reason for this is due to the polish-pan 120 being installed on the base, covering access to the center-bump bolt 330.

Center-Bump Bolt 330, and Pan-Bracket Assemblies 140.

The center-bump bolt 330 of the polish pan 120 pulls on the pan-center so that the polish-pan becomes snug against the outer bump bolts. Polish-pan bracket assemblies 140 assist in pulling polish-pan 120 down against outer bump bolts 412. FIG. 4C. The gears 418 and 420 move center-bump bolt 330 down or up as required to maintain the polish-pan convex or flat at the outer bump bolts, and concave or convex as needed at the center bump 330. The casting when put into the polish-pan 120 will ride primarily either on the outer bump bolts 412 or on the center bump bolt head 332 as needed to provide the proper polish over the outer and inner casting areas in separate phases.

Limit Bolts

Limit bolts 416 are provided on the base-board 410 to limit the amount that the polish-pan bottom 320 can be pulled down by the pan bracket assemblies 140 as they are tightened. FIG. 4C. The square shape of square hole 430 (FIG. 4A) in driven-gear 420 turns square nut 426 when driven gear 420 is turned by means of driving gear 418. This action provides a tension on center-bump bolt 330 to lower polish-pan bottom 320. When driving gear 418 is turned in the opposite direction, tension on the polish pan-bottom 320 is released or reduced so that the pan-bottom rises.

Gear Hold-Down Bar 422

Gear hold-down bar 422 holds square nut 426 down during tension on center-bump bolt 330. The natural tension in the polish-pan bottom 320 when it is being pulled down, is released when the polish-pan bottom is allowed to move back to its original position by rotating the square nut 426 in the opposite direction by means of driven gear 420.

Operation of Circulator System 150 Comprises:

Circulator system 150 drives the casting 110 via the casting rotation fixture 216 shown in FIGS. 1B & 2.

Casting Rotation Motor and Circulation Motor.

Figure 10:
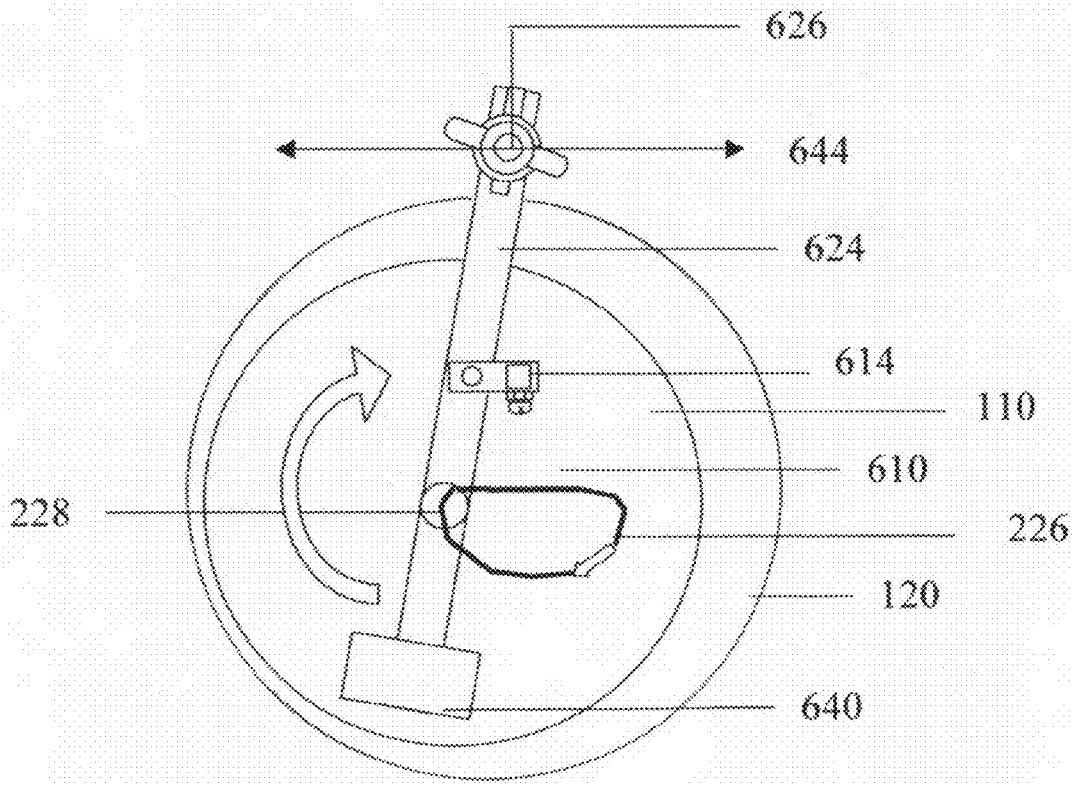
FIG. 10 shows an outline diagram top-view of the casting circulating in the polish-pan.

Casting rotation motor 630 rotates casting 110 around its own center axis 218. FIG. 1B. Casting center axis 218 is shown in FIG. 2. Casting rotation motor 630 rides on circulator arm 624 as circulator arm 624 moves. Circulation motor 632 rotates casting rotation screw 228 independently in casting axis pattern 226 as shown in FIGS. 2A and 10. Circulator arm 624 moves back and forth in response to the action of circulation motor 632, with the motion of the end opposite rotation motor support 640 fixed about the fulcrum-screw 626. Circulation motor 632 and circulator arm 624 cannot move casting 110 by themselves without the help of the steady vibration provided by vibrating table 135 (not a part of this patent). This vibration effectively makes casting 110 very light so that it can be circulated easily by circulator arm 624 under the influence of circulation motor 632 and casting rotation motor 630.

Circulation Assembly, Top View

Figure 11:
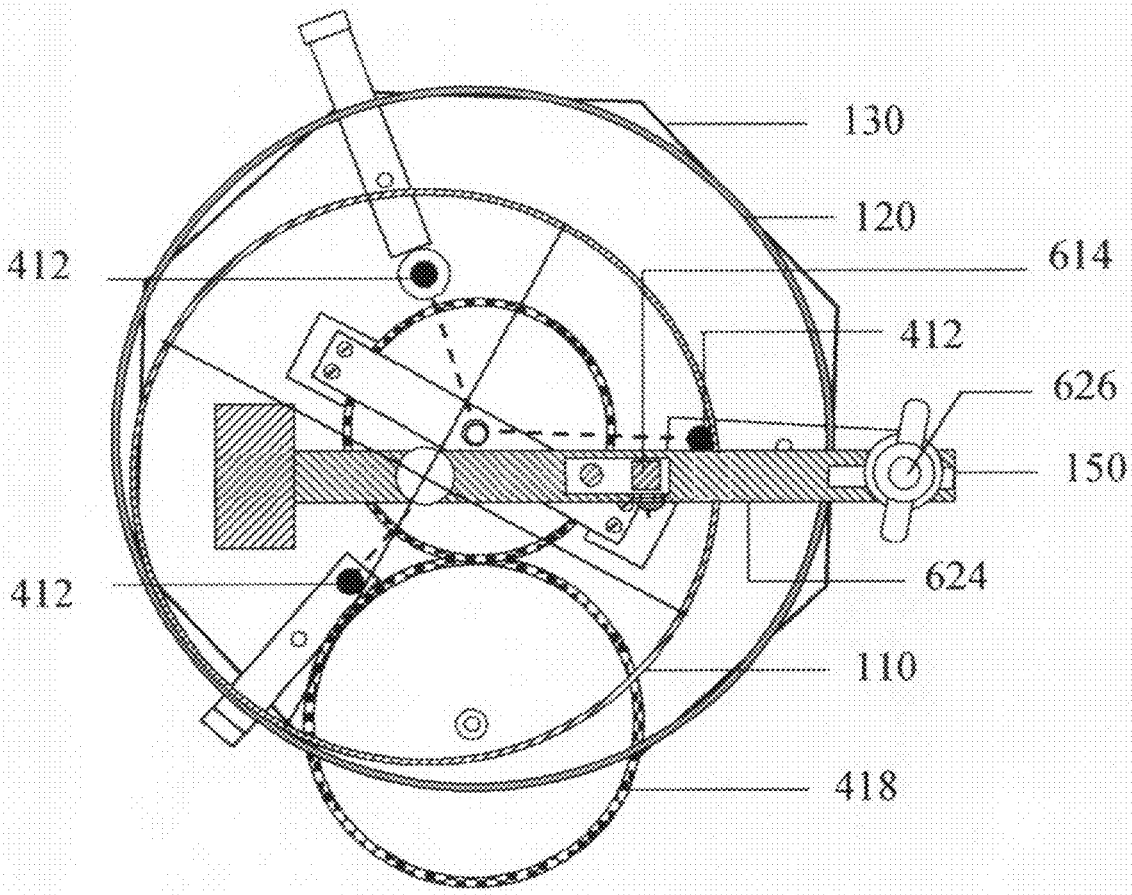
FIG. 11 shows a more detailed outline view of the casting in the polish-pan with its circulating apparatus and base bolts.

FIG. 11 shows a top view of circulator system 150. Casting 110 and polish-pan 120 are shown in transparent form in FIG. 11 so that the relationship between the circulator system 150 and the base assembly 130 can be seen.

Circulation Patterns

Circulation Pattern of a Point on the Casting.

Figure 12:
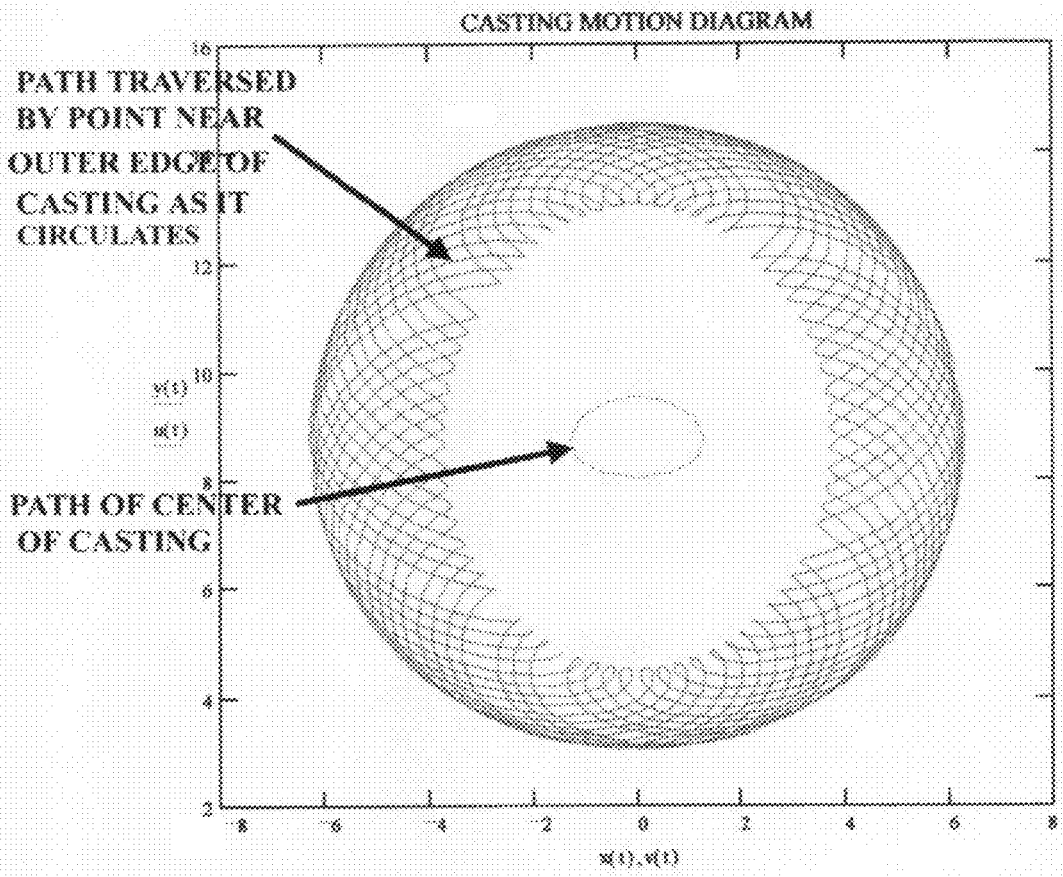
FIG. 12 is a diagram of the pattern produced by a point on the casting as it circulates.

FIG. 12 shows the pattern generated by the a point near the outer edge of casting 110 *t* circulates under the combined influence of circulation motor 632 and casting rotation motor 630. This shows that the referenced point on the casting covers essentially the total outer area of polish pan 120, thus guaranteeing that all points on the casting surface with the exception of the center area move over any particular outer bump bolt of base 130 numerous times during the polish cycle. Center area is polished by center bump 330.

Circulation Pattern Produced By Bumps On the Underside of the Casting.

Figure 12A:
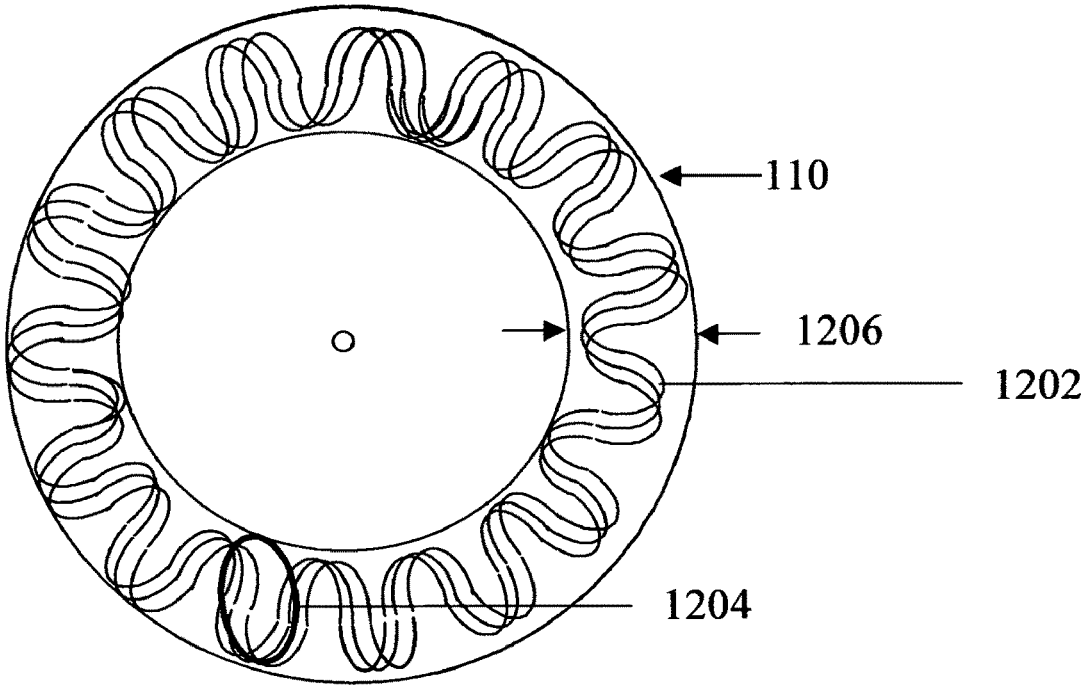
FIG. 12A shows the pattern produced by a single bump on the underside of the casting with both circulator and rotator motors operating.

Another way of viewing the pattern of FIG. 12 produced by circulation of the casting is shown in FIG. 12A. A particular outer bump bolt 412 writes a pattern on the underside of casting 110 as the casting circulates. Each time casting 110 makes a full revolution about its own center, the next pattern is offset. This can be seen in FIG. 12A, which shows three cycles as a result of three revolutions of casting rotation motor 630. These revolutions form a band 1206 whose width is determined by the amplitude of the circulator pattern 1204 in FIG. 12A. Eventually, the entire band is filled in causing the band on casting 110 to be completely polished. Isolated circulator motor revolution pattern 1204 is taken with casting rotation motor 630 turned off. This pattern may be compared to FIG. 2A.

Figure 12B:
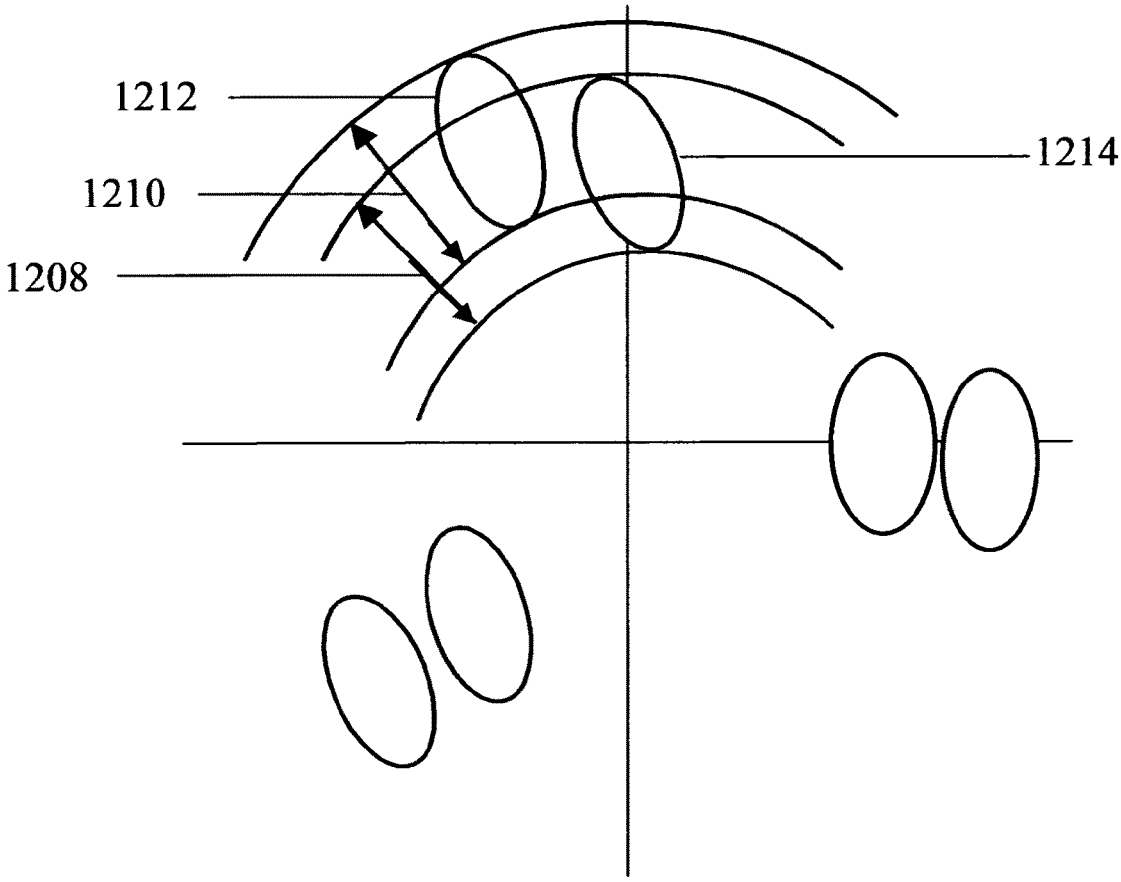
FIG. 12B shows the patterns generated by all three bumps simultaneously with circulator motor 632 operating and rotator motor 630 shut off.
Figure 13:
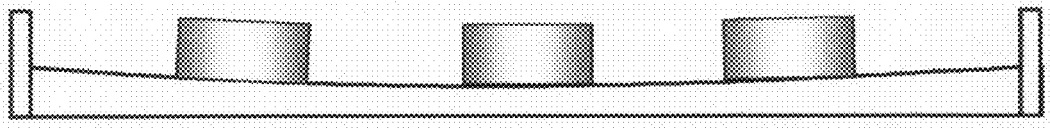
FIGS. 13-13B show diagrams of prior-art vibrating-laps.
Figure 13A:
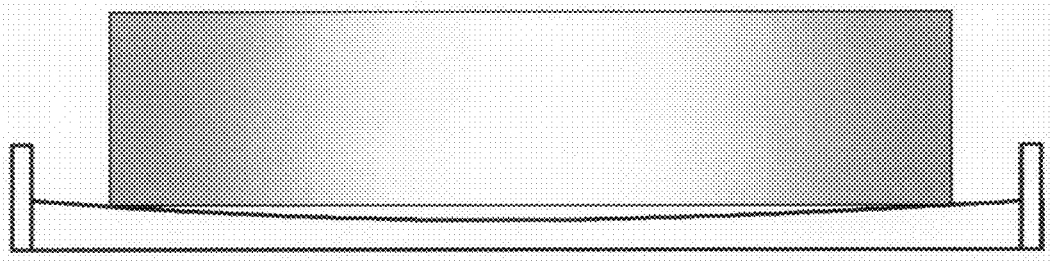
Figure 13B:
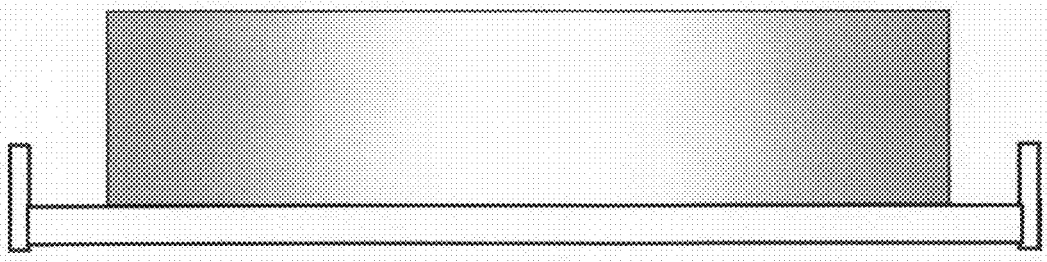

Test Setup For Generating FIGS. 12A & 12B

A test setup was constructed consisting of a plastic disc to simulate the casting. The plastic disc was covered with drawing paper and a ballpoint pen pressing down under pressure at the exact position of each outer bump bolt. This created a circulation pattern on the drawing paper. A typical pattern 1202 for one outer bump bolt is shown in FIG. 12A. Note that the pattern 1202 forms a band 1206. Pattern 1204 is the pattern created by only circulation motor 632 with casting rotation motor 630 turned off. The pattern 1204 determines the pattern band shown as 1206. Such bands are created by each outer bump bolt 412. The position of each pattern band 1206 is determined by the position of the outer bump bolt and the horizontal position of support structure 736. The combination of these three bands effectively covers the entire portion of casting 110.

Explanation of Patterns of FIG. 12B.

The patterns of FIG. 12B were generated by all three outer bump bolts simultaneously with circulator motor 632 operating and rotator motor 630 shut off. This isolates the pattern created solely by circulation motor 632 on the three outer bump bolts 412. It takes the general form of pairs of ellipses. The ellipses on the righthand side of each pair are generated with support box 710 fully left. The ellipses on the lefthand side of each pair are generated with support box 710 in the fully right position. The pairs of ellipses form two overlapping bands indicated by double-ended arrows 1208 and 1210. When rotator motor 630 is operating, the pattern in each band is expanded similar to that shown in FIG. 12A. These overlapping, expanded bands cause casting 110 to be fully polished all around each band. Only one set of the three bands in FIG. 12A is diagrammed for clarity.

Fulcrum Screw 626. See FIGS. 6I, 6J, 9 & 10.

Fulcrum screw 626 can be moved forward and back by means of x-adjuster 628 to finely position the casting in the pan. This is shown by horizontal arrows 644 in FIG. 10. This forward and back movement is called the X-direction 644.

Operation of Support Box 710, FIG. 7, Comprises:

A support box 710 in FIG. 7 supports circulator motor 632. Brace 716 braces circulator motor 632 against movement caused by motion of circulator arm 624 as in FIG. 6. Horizontal position screw 712 causes support box 710 to slide either right or left depending on the direction of turn of handle 714. This action moves casting 110 right or left to assist in covering the entire casting surface to be polished. Slide-bolts 734 and slide washers 732 supporting support box 710 slide in 3 slots 730 shown in FIG. 7A.

Support Structure 170, Side View.

FIG. 7B shows gemstone flat polisher, mechanized in side view, in abbreviated form.

Figure 8:
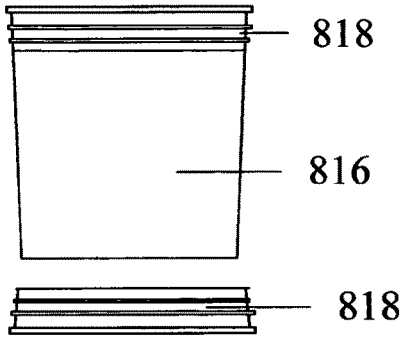
FIG. 8 shows the plastic-bucket from the side.
Figure 8A:
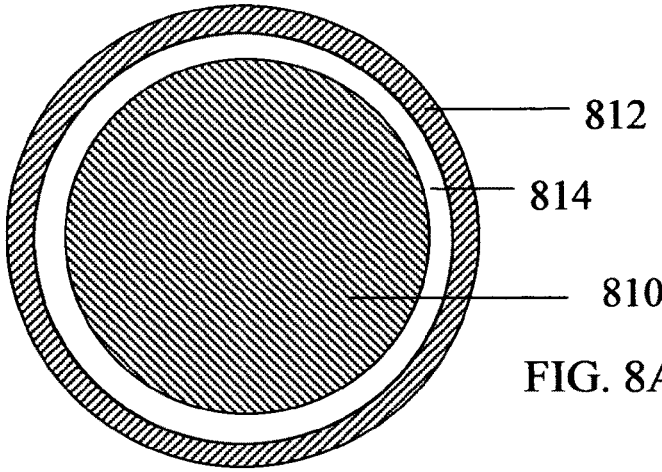
FIG. 8A shows the casting-tray from the top.
Figure 8B:
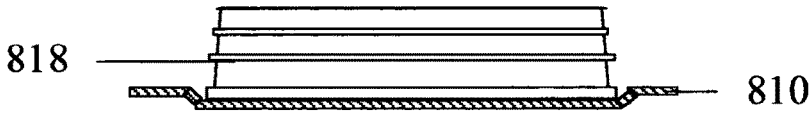
FIG. 8B shows the casting-mold and casting-tray from the side.
Figure 8C:
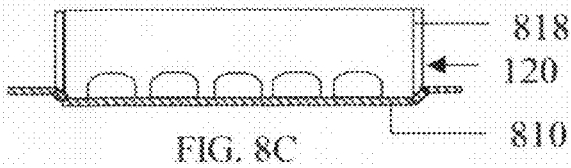
FIGS. 8C-8F show various stages in the construction of a casting.
Figure 8D:
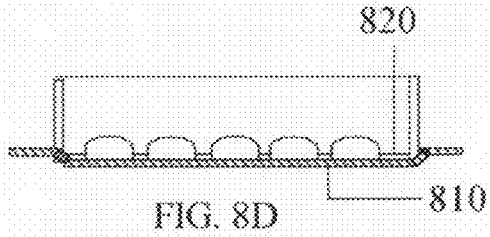
Figure 8E:
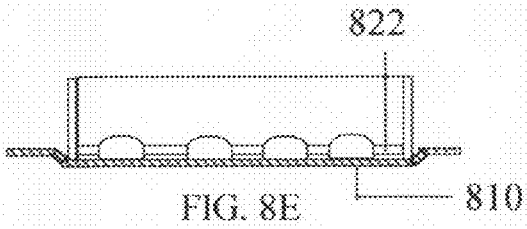
Figure 8F:
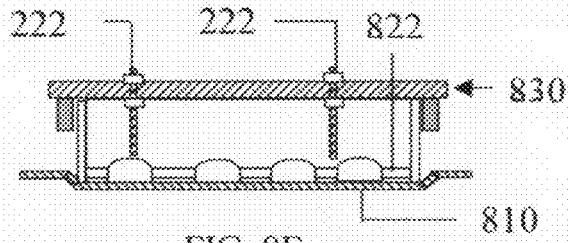
Figure 8G:
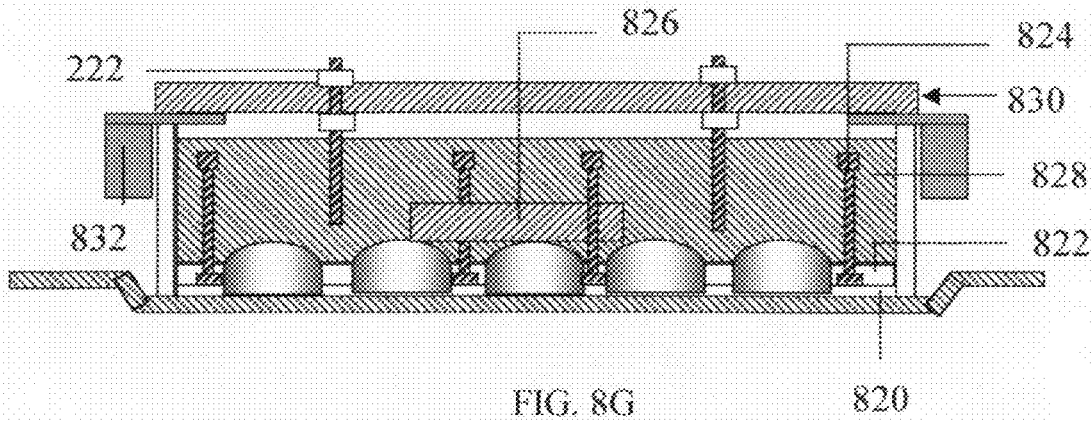
FIG. 8G shows a schematic side-view of the completed casting.
Figure 8H:
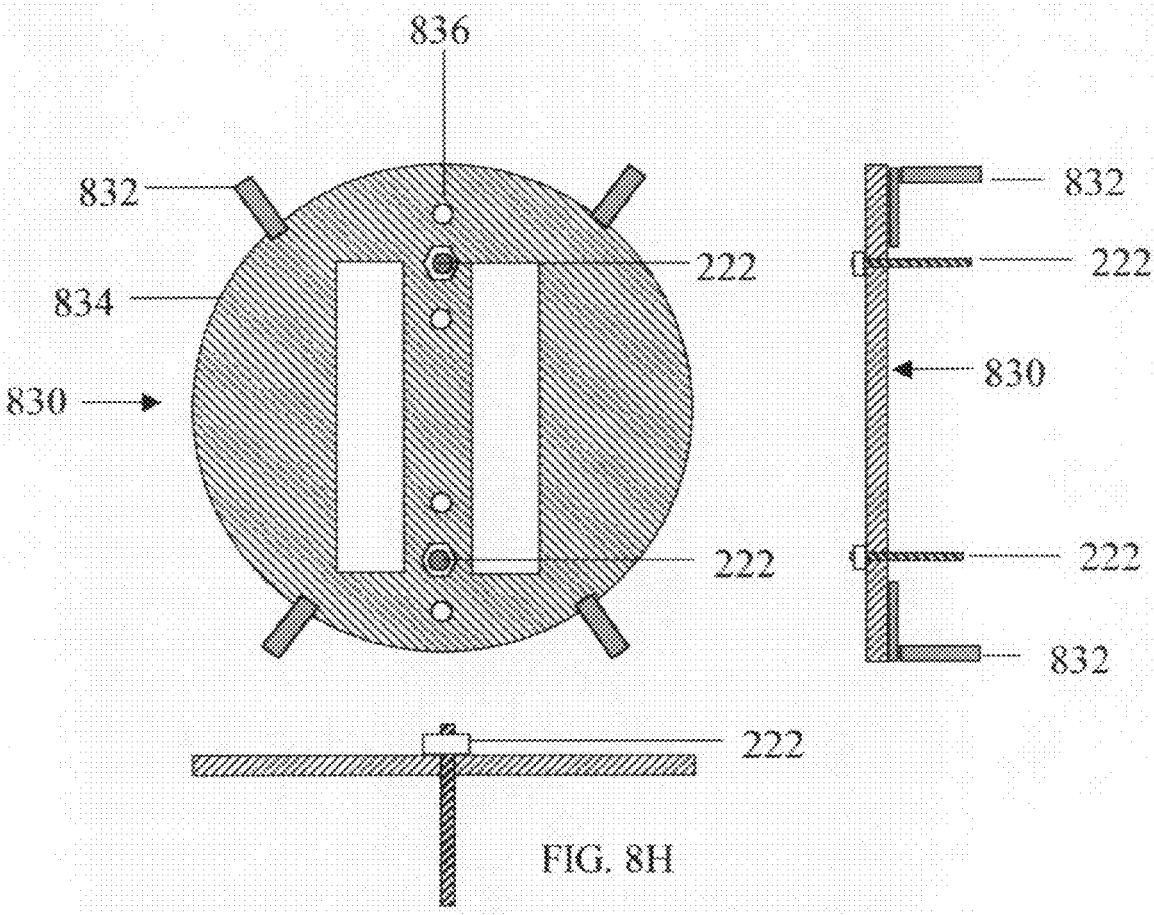
FIG. 8H shows the stud-insertion fixture from three directions simplified.

Casting Preparation Method FIGS. 8-8H

A method of preparing a casting 110 of flat-sided items, and having a maximally-flat bottom casting plane surface 220, comprising:

a. Providing a plastic bucket 816 and constructing a mold ring 818. FIGS. 8 & 8B.
b. Providing a casting tray 810 in FIG. 8A with rim 812 with a ribbon of putty tape sealer 814 and pressing mold-ring 818 into it to seal edges. FIG. 8B. The first embodiment of sealant is putty tape.
c. Inserting and arranging the flat-bottomed rocks 212 down onto the casting tray 810. FIG. 8C.
d. Inserting a layer of water 820 into the casting to cover the bottom edges of the flat-bottomed rocks. FIG. 8D.
e. Heating the casting water layer 820 by setting casting tray 810 on a hot plate.
f. Heating and melting paraffin wax in a double-boiler on a separate hot plate.
g. Pouring a layer of melted paraffin wax 822 into the casting mold onto the top of the heated water layer such that the top of wax layer 822 reaches approximately half way up the flat-bottomed rocks. The wax floats on the water layer. FIG. 8E.
f. Removing assembly FIG. 8E from heat and setting the assembly on a level, flat surface. Allowing wax to harden.
g. Selecting holes 836 shown if FIG. 8H for lifting-studs 222 in stud-insertion fixture 830. FIG. 8F. Selected holes are equidistant from the casting center and must prevent studs from touching tops of flat-bottomed rocks h. Mixing up a batch of casting cement 828 and pouring mold ring 818 one-half full into casting. Adding weight 826 near the casting center. FIG. 8G. Then pouring other half of casting cement 828 to fill mold ring 818. The first embodiment material for the casting cement is pure Portland cement and the first embodiment material for the weight 826 is lead to provide sufficient weight. The lead weight can be easily made by melting old tire balancing weights.

i. Installing stud-insertion fixture 830 by setting it on top of casting and sinking lifting studs 222 into the cement. FIG. 8G.

j. Removing mold-ring 818 when cement has become firm by lightly tapping mold-ring with a hammer.

k. Installing casting rotation fixture 216 as shown in FIGS. 1B and 2. Its height is adjusted to mate properly with casting rotation motor 630 and so that circulator-arm 624 sits approximately level when installed. Height adjustment nuts 217 and leveling nuts 224 are adjusted for this purpose.

l. Preparing casting plane surface 220 for polishing using other equipment not included in this patent application. Note that plane surface 220 is caused to be maximally-flat due to its construction and preliminary processing methods. These methods comprise coarse and fine flat grinding by other equipment.

I claim:

1. A polishing system for polishing a flat workpiece, the workpiece comprising a plurality of flat items having at least one flat surface, the flat items cemented together with a cementing material to form a casting having at least one flat surface formed of the at least one flat surface of the plurality of flat items;

the system comprising a polishing pan comprising a circular, flexible bottom portion, the bottom portion lined with at least one resilient material; the pan further comprising a vertical peripheral wall attached to and surrounding the bottom portion, and means for polishing the workpiece contained in the pan, and contacting the bottom portion and an interior surface of the vertical peripheral wall;

a base having an upper flat surface, the base further comprising means to raise and lower the center of the bottom of the pan; the base comprising means to provide separate elevated areas in the bottom of the pan;

means to mount the polishing pan on the base means to provide circulation of the workpiece; and means to provide rotation of the workpiece.

2. The polishing system of claim 1 wherein the means to raise and lower the center of the bottom of said polishing pan comprises a horizontal gearing system adjustable from the outside work area during continuous operation; said gearing system comprises an inner gear attached to a bolt which is attached to said pan center, an outer gear meshed with said inner gear, said outer gear is manually operated from the adjacent work area.

3. The polishing system of claim 1, wherein the means to provide elevated areas in the bottom of said polish pan comprises round headed bolts set into the base, such that the rounded heads of the bolts are away from the top surface of the base; the bolts arranged approximately in a circle about a center axis of the base and at a predetermined distance from the center axis, so that when the bottom portion is mounted on the base by the means to mount the pan on the base, the round heads of the bolts cause separate areas of the bottom portion to be elevated.

4. The polishing system of claim 1 wherein the means to mount the polishing pan on the base comprises three identical assemblies, each of the three assemblies comprises an inverted-L shaped outer brace attached to a pan-bracket-attachment at its lower end, said pan-bracket attachment in-turn attached to the base; an inner inverted –L shaped brace facing said outer brace and connected to said outer brace by means of a threaded bolt and a non-threaded guide bolt, each bolt passing through the top of each of the outer and inner braces; the lower end of said inner brace presses down against the interior edge of the polish pan.

5. The polishing system of claim 1, wherein the means for circulating the workpiece comprises a motor, an arm attached to the motor, and means to attach the arm to the workpiece.

6. The polishing system of claim 1, wherein the means for rotating the workpiece comprises a motor, means to attach the workpiece to the motor for rotating the workpiece about its central axis.

* * * * *